US010517386B2

(12) United States Patent
Zimmerman

(10) Patent No.: US 10,517,386 B2
(45) Date of Patent: Dec. 31, 2019

(54) SELF-RIGHTING TOOTHBRUSH

(71) Applicant: Israel Harry Zimmerman, Los Angeles, CA (US)

(72) Inventor: Israel Harry Zimmerman, Los Angeles, CA (US)

( * ) Notice: Subject to any disclaimer, the term of this patent is extended or adjusted under 35 U.S.C. 154(b) by 352 days.

(21) Appl. No.: 15/474,213

(22) Filed: Mar. 30, 2017

(65) Prior Publication Data

US 2018/0279765 A1 Oct. 4, 2018

(51) Int. Cl.

| | |
|---|---|
| ***A46B 15/00*** | (2006.01) |
| ***A46B 9/04*** | (2006.01) |
| ***A46B 5/02*** | (2006.01) |

(52) U.S. Cl.

CPC ..... *A46B 15/0097* (2013.01); *A46B 5/02* (2013.01); *A46B 5/026* (2013.01); *A46B 9/04* (2013.01); *A46B 2200/1066* (2013.01)

(58) Field of Classification Search

CPC .. A46B 5/00; A46B 5/02; A46B 5/021; A46B 5/026; A46B 9/04; A46B 15/0097; A46B 2200/1066

USPC ..... 15/143.1, 167.1

See application file for complete search history.

(56) References Cited

U.S. PATENT DOCUMENTS

| | | | |
|---|---|---|---|
| 2,722,703 | A | 11/1955 | Green |
| 3,968,950 | A | 7/1976 | Gallo |
| 5,228,166 | A | 7/1993 | Gomez |
| 5,517,713 | A | 5/1996 | Hadcock |
| 5,860,190 | A | 1/1999 | Cano |
| 5,956,796 | A | 9/1999 | Lodato |
| 6,490,760 | B1 | 12/2002 | Lauer et al. |
| 7,007,335 | B1 | 3/2006 | Doat |
| 7,527,446 | B2 | 5/2009 | Johnson Papa et al. |
| 8,650,697 | B2 | 2/2014 | Lombardi |
| 8,769,832 | B1 | 7/2014 | Joyner |

(Continued)

FOREIGN PATENT DOCUMENTS

| | | |
|---|---|---|
| CH | 703696 | 3/2012 |
| CN | 200950895 | 3/2001 |

(Continued)

OTHER PUBLICATIONS

PCT International Searching Authority, International Search Report and Written Opinion, PCT International Application No. PCT/US2018/013885, dated Jul. 9, 2018, 13 pages.

(Continued)

*Primary Examiner* — Mark Spisich
(74) *Attorney, Agent, or Firm* — Walter W. Duft

(57) ABSTRACT

A self-righting toothbrush includes a shaft having a head section, a medial section and a tail section. The medial section has curved pivot surface configured to contact a horizontal support surface at a pivot point, the pivot surface allowing the toothbrush to roll on the support surface. An external ballast has an outer contour exposed at a surface of the shaft. The ballast is positioned to induce the toothbrush to roll on the support surface from an unstable orientation wherein the bristles are non-vertical, to a stable orientation wherein the bristles are vertical (up or down). In one aspect, the ballast has an irregular outer contour. In another aspect, the ballast outer contour is limited to the toothbrush medial section. In another aspect, the ballast outer contour provides a relatively flat reference protrusion of the pivot surface that is opposite from a relatively tall primary protrusion of the pivot surface.

30 Claims, 10 Drawing Sheets

(56) References Cited

U.S. PATENT DOCUMENTS

| | | | |
|---|---|---|---|
| 9,861,187 | B2 | 1/2018 | Zimmerman |
| 2004/0025272 | A1 | 2/2004 | Svartzak |
| 2004/0143920 | A1 | 7/2004 | Nanda |
| 2007/0039109 | A1 | 2/2007 | Nanda |
| 2008/0311282 | A1 | 12/2008 | Hammon |
| 2014/0053357 | A1 | 2/2014 | Barzel |
| 2017/0347791 | A1 | 12/2017 | Zimmerman |

FOREIGN PATENT DOCUMENTS

| | | | |
|---|---|---|---|
| DE | 202011002076 | U1 | 9/2011 |
| EP | 1277420 | | 10/2005 |
| GB | 2443888 | A | 5/2008 |
| JP | 2006000466 | | 1/2006 |
| KR | 1020100103227 | | 9/2010 |
| WO | WO9833789 | | 9/1998 |
| WO | WO9844823 | | 10/1998 |
| WO | WO0117391 | | 9/1999 |

OTHER PUBLICATIONS

PCT International Searching Authority, International Search Report and Written Opinion, PCT International Application No. PCT/US2016/052135, dated Feb. 13, 2017.

PCT International Searching Authority, International Search Report and Written Opinion, PCT International Application No. PCT/US2017/051737, dated Feb. 1, 2018.

SELF-RIGHTING TOOTHBRUSH

BACKGROUND

1. Field

The present disclosure relates to toothbrush technology. More particularly, the disclosure is directed to improvements in toothbrush sanitation.

2. Description of the Prior Art

By way of background, toothbrushes have become evergreen products and a vital tool necessary for oral health. At the same time, given the environment that toothbrushes are used in, cleanliness is a crucial element of safe use. It is well known that the mouth, and the gums in particular, are efficient portals for transporting bacteria through the body, which is why some people with certain health issues are required to take antibiotics prior to certain dental procedures.

The standard toothbrush has an elongated shaft with bristles attached to one end and the other end forming a handle. In a typical bathroom environment, a toothbrush is often placed on surfaces that harbor bacteria and other microorganisms, such as on a counter top next to a sink, on a shelf in a medicine cabinet, in a drawer, etc. Unless the toothbrush is placed on the surface with the bristles facing up, the bristles can contact the surface and any microorganisms that may be present thereon can transfer to the bristles and subsequently enter the mouth. Notwithstanding the foregoing, toothbrush users at one time or another have placed their toothbrushes onto counter tops where the bristle end of the toothbrush is either laid on its side or face down. This is particularly pronounced with younger children that may not be as cognizant of hygienic protocol.

It is to improvements in toothbrush sanitation that the present disclosure is directed. In particular, a self-righting toothbrush is disclosed that is configured to pivot to a bristles up (or down) position in most instances when the toothbrush is dropped or placed onto a surface.

SUMMARY

A self-righting toothbrush includes a shaft having a first side, a second side and a pair of lateral edges. The shaft defines a head section, a tail section and a medial section, the medial section being disposed at a junction of the head section and the tail section in a longitudinal direction of the toothbrush. The head section mounts a set of bristles on the first side of the shaft.

The medial section has a curved pivot surface configured to contact a horizontal support surface at a pivot point, the pivot surface allowing the toothbrush to roll on the support surface. The pivot point lies on the pivot surface and represents its instantaneous point of contact with the support surface at any given rotational position of the toothbrush, the pivot point lying in a vertical plane that is substantially perpendicular to a rolling direction of the toothbrush.

An external ballast having an outer contour of irregular shape along a longitudinal length thereof is exposed at a surface of the shaft. The ballast is positioned to induce the toothbrush to roll on the support surface from an unstable orientation wherein the bristles extend in a non-vertical direction, to a stable orientation wherein the bristles extend in a vertical direction in either a bristles up position or a bristles down position.

In an embodiment, the ballast may have one or more surface texture features including one or both of ridges or channels.

In an embodiment, the outer contour of the ballast may form part of the pivot surface.

In an embodiment, the ballast may be mounted in a pocket formed in the toothbrush shaft.

In an embodiment, the toothbrush shaft may be a molded article and the ballast may be an overmolded member.

In an embodiment, the ballast may include a higher density material than the shaft.

In an embodiment, the ballast may include a softer material than the shaft.

In an embodiment, the ballast may be exposed at a surface portion of the shaft that encompasses less than all sides of the shaft.

In an embodiment, the ballast may be limited to the medial section of the toothbrush.

In an embodiment, the outer contour of the ballast may form a relatively flat reference protrusion of the pivot surface that is opposite from a relatively tall primary protrusion of the pivot surface.

In an embodiment, the reference protrusion may be substantially flush with longitudinally adjacent surface portions on the same side of the shaft as the reference protrusion.

In another aspect, a self-righting toothbrush includes a shaft having a first side, a second side and a pair of lateral edges. The shaft defines a head section, a tail section and a medial section, the medial section being disposed at a junction of the head section and the tail section in a longitudinal direction of the toothbrush. The head section mounts a set of bristles on the first side of the shaft.

The medial section has a curved pivot surface configured to contact a horizontal support surface at a pivot point, the pivot surface allowing the toothbrush to roll on the support surface. The pivot point lies on the pivot surface and represents its instantaneous point of contact with the support surface at any given rotational position of the toothbrush, the pivot point lying in a vertical plane that is substantially perpendicular to a rolling direction of the toothbrush.

An external ballast has an outer contour exposed at a surface of the shaft, and is limited to the medial section of the toothbrush. The ballast is positioned to induce the toothbrush to roll on the support surface from an unstable orientation wherein the bristles extend in a non-vertical direction, to a stable orientation wherein the bristles extend in a vertical direction in either a bristles up position or a bristles down position.

In another aspect, a self-righting toothbrush includes a shaft having a first side, a second side and a pair of lateral edges. The shaft defines a head section, a tail section and a medial section, the medial section being disposed at a junction of the head section and the tail section in a longitudinal direction of the toothbrush. The head section mounts a set of bristles on the first side of the shaft.

The medial section has a curved pivot surface configured to contact a horizontal support surface at a pivot point, the pivot surface allowing the toothbrush to roll on the support surface. The pivot point lies on the pivot surface and represents its instantaneous point of contact with the support surface at any given rotational position of the toothbrush, the pivot point lying in a vertical plane that is substantially perpendicular to a rolling direction of the toothbrush.

The pivot surface is provided in part by a relatively tall primary protrusion defined on a first one of the first or second sides of the shaft. The pivot surface is further provided in part by a relatively flat reference protrusion defined on a second one of the first or second sides of the shaft.

An external ballast has an outer contour exposed at a surface of said shaft. The ballast is positioned to induce the toothbrush to roll on the support surface from an unstable orientation wherein the bristles extend in a non-vertical direction, to a stable orientation wherein the bristles extend in a vertical direction in either a bristles up position or a bristles down position.

The outer contour of the ballast includes the relatively flat reference protrusion.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Figure 1:
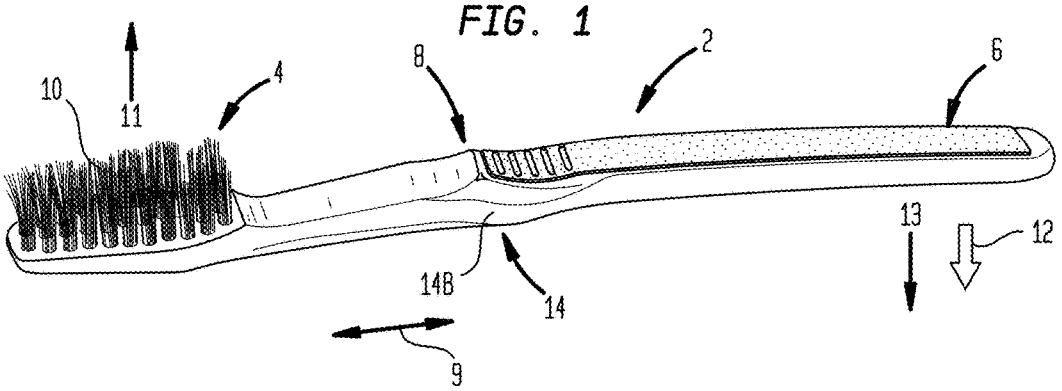
FIG. 1 is a perspective view showing an example embodiment of a self-righting toothbrush that may be constructed in accordance with the present disclosure.

Turning now to the drawing figures, in which like reference numbers illustrate like structure in all of the several views, FIGS. 1-4 illustrate an example embodiment of a self-righting toothbrush 2 having a head section 4, a tail section 6, and a medial section 8. The medial section 8 is disposed at a junction of the head section 4 and the tail section 6 in a longitudinal direction 9 of the toothbrush 2. The distal end of the head section 4 mounts a set of bristles 10. Unless otherwise indicated, the materials used to fabricate the toothbrush 2 are the same as may be found in conventional toothbrushes, which are mainly plastics such as polypropylene or polyethylene for the rigid non-bristle component(s), and Nylon for the bristles.

Figure 2:
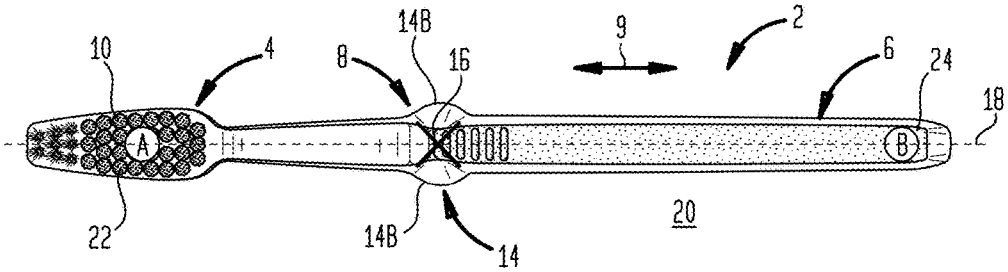
FIG. 2 is a plan view showing the front of the toothbrush of FIG. 1 with the rear of the toothbrush resting on a horizontal support surface in a bristles up position.
Figure 3:
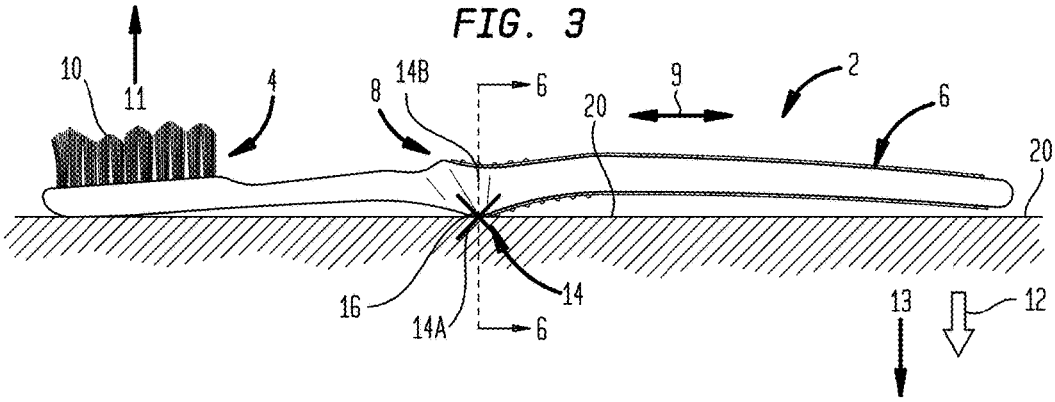
FIG. 3 is a side view of the toothbrush of FIG. 1 with the toothbrush positioned as in FIG. 2 with the rear of the toothbrush resting on the support surface in a bristles up position.
Figure 4:
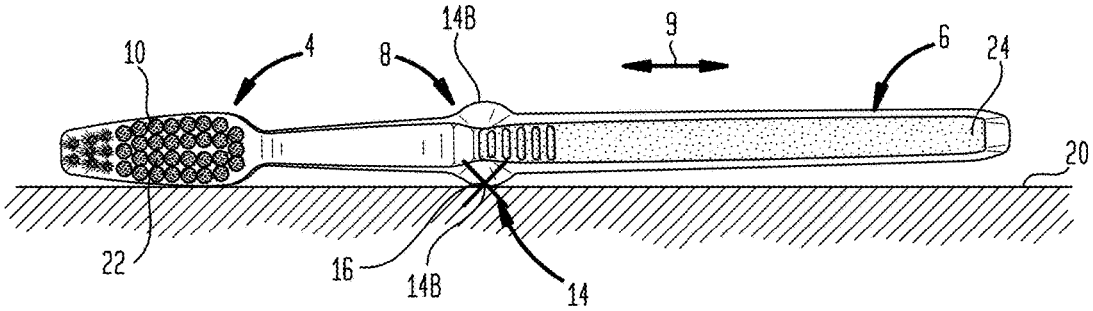
FIG. 4 is a side view of the toothbrush of FIG. 1 with a side edge of the toothbrush resting on the support surface in a non-bristles up position.
Figure 5:
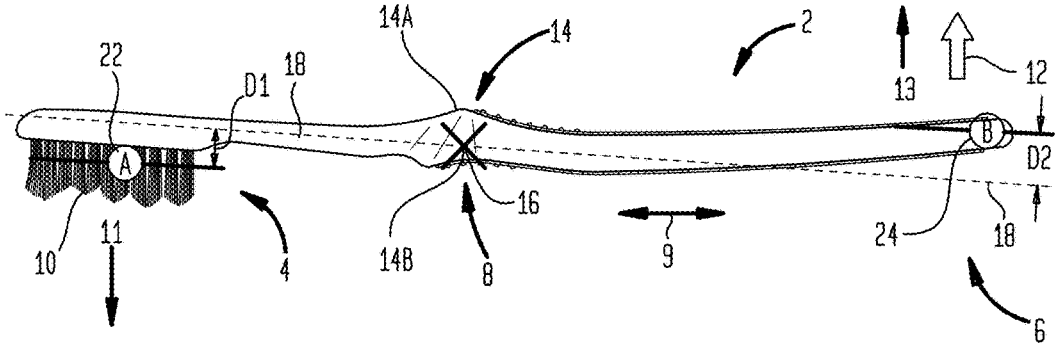
FIG. 5 is a plan view of the toothbrush of FIG. 1 positioned as in FIG. 4 with a side edge of the toothbrush resting on the support surface in a non-bristles up position.

As can be seen in FIGS. 1, 3 and 5, the bristles 10 extend in a frontward direction 11 of the toothbrush 2, starting from their point of attachment to the head section 4. The tail section 6 has a lateral asymmetry 12 that extends in a rearward direction 13 of the toothbrush 2, which is generally opposite to the frontward direction. Is so desired, the head section 4 may also have some degree of lateral asymmetry in the rearward direction 13. The medial section 8 has a curved pivot surface 14 that contacts a horizontal support surface 20 at a pivot point 16 (see FIGS. 2-5) when the toothbrush is placed on the support surface. The pivot point 16 is situated on the pivot surface 14 and represents its instantaneous point of contact with the support surface 20 at any given rotational position of the toothbrush 2. As described in more detail below, the pivot surface 14 allows the toothbrush 2 to undergo pivoting so as to roll the toothbrush on the support surface 20. It will be appreciated that as such rolling occurs, the pivot point's location on the pivot surface 14 will change as different regions of the pivot surface come into contact with the support surface 20.

For reference purposes, the plan views of FIGS. 2 and 5 depict a longitudinal axis 18 that is aligned with the pivot point 16 in a common vertical plane for any rotational position of the toothbrush 2. The longitudinal axis 18 is oriented substantially perpendicular to the direction in which the toothbrush rolls as it pivots. In most cases, the longitudinal axis 18 will extend generally in the elongated longitudinal direction 9 of the toothbrush. The vertical plane that includes the pivot point 16 and the longitudinal axis 18 will likewise be substantially perpendicular to the direction of toothbrush rolling.

Figure 6:
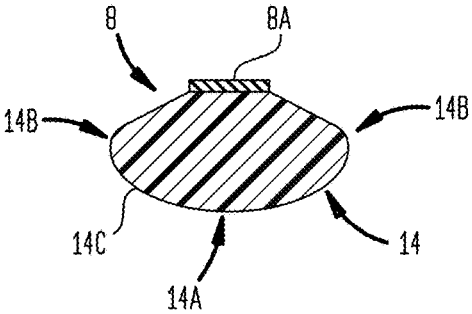
FIG. 6 is a cross-sectional view taken along line 6-6 in FIG. 3 through the medial section of the toothbrush of FIG. 1.

In the disclosed embodiment of FIG. 1, the pivot surface 14 may include a rearward protrusion 14A and two lateral protrusions 14B, one on each side of the rearward protrusion (see FIGS. 2, 3 and 4). As shown in FIG. 6, the pivot surface 14 may have a substantially continuous curve 14C of selected shape (e.g., circular, oval, etc.) that extends between the lateral protrusions 14B, and through the rearward protrusion 14A. This configuration allows the toothbrush 2 to roll smoothly on the support surface 20. If desired, the pivot surface 14 may terminate at the lateral protrusions 14B, such that there is no pivot surface per se on the front side of the medial section 8. The range of pivoting and rolling will then lie between positions in which the toothbrush 2 is oriented in a non-bristles up position with the bristles 10 extending generally horizontally and parallel to the support surface 20. FIGS. 4 and 5 represent the first such bristles sideways position. The second such bristles sideways position is when the toothbrush 2 is pivoted 180° from the position shown in FIGS. 4 and 5. In these positions, the tail section's rearward lateral asymmetry 12 also extends generally horizontally and parallel to the support surface 20, as shown in FIG. 5. The midpoint of the range of pivoting and rolling is a bristles up position in which the bristles 10 extend vertically away from and perpendicular to the support surface and the tail section's rearward lateral asymmetry 12 extends toward the support surface, as shown in FIGS. 2 and 3.

Figure 11:
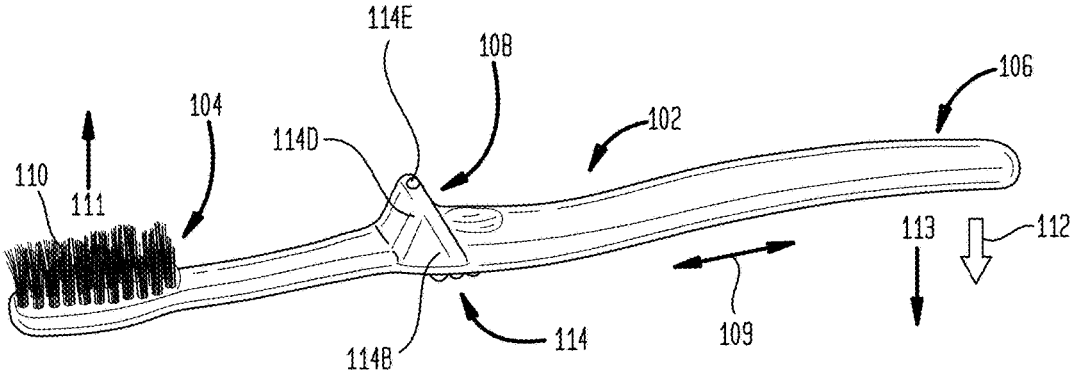
FIG. 11 is a perspective view showing another example embodiment of a self-righting toothbrush that may be constructed in accordance with the present disclosure.

As shown in FIG. 6, the front side of the medial section 8 may angle toward a flat front surface that may be ridged to provide a thumb grip 8A of the toothbrush 2. It will be appreciated that without a pivot surface on the front side of the medial section 8, the toothbrush 2 will not naturally pivot from a strictly bristles down position in which the bristles extend directly toward the support surface 20. In this position, the ends of the bristles 10 may rest on the support surface 20 as a first point of contact, and a second point of contact may be somewhere along the front side of the tail section 6. Depending on its size, the front side of the medial section 8 may or may not contact the support surface 20. In either case, pivoting may be effectively prevented in the bristles down position. This may be advantageous in that 360 degree pivoting, which could cause the toothbrush 2 to roll off the support surface 20, is prevented. On the other hand, if it is desired to extend the range of pivoting toward and possibly including the bristles down position, the pivot surface 14 may be extended to include some or all of the front side of the medial section 8. This is illustrated in the embodiment of FIG. 11, described in more detail below. It should be noted that for the bristles up position, stability and resistance to 360 degree rolling is provided by the somewhat flattened surface contour near the midpoint of the rearward protrusion 14A. This surface flattening can be seen in FIG. 6. Further flattening of the rearward protrusion 14A would add additional stability. This is illustrated in the embodiment of FIG. 11.

As shown in FIGS. 2 and 5, the head section 4 and the tail section 6 of the toothbrush 2 have a respective head section center of mass 22 (Mass "A") and a tail section center of mass 24 (Mass "B"). When the toothbrush 2 is in a bristles up position, as shown in FIG. 2, the head section center of mass 22 and the tail section center of mass 24 are substantially aligned with the pivot point in a stable non-pivoting orientation. In particular, the head section center of mass 22 and the tail section center of mass 24 lie substantially in the vertical plane that includes the longitudinal axis 18 and the pivot point 16. It will be appreciated that the same alignment occurs when the toothbrush is rotated 180 degrees to the bristles down position. When the toothbrush 2 is in a non-bristles up position, such as when the bristles are oriented generally horizontally as shown in FIG. 5 (the bristles sideways position), the tail section center of mass 24 assumes non-neutral unstable positions. In particular, the tail section center of mass 24 is laterally spaced from the vertical plane that includes the longitudinal axis 18 and the pivot point 16. The head section center of mass 22 may also assume non-neutral positions on the same or opposite side of the same vertical plane.

In FIG. 5, the head section center of mass 22 is laterally spaced from the longitudinal axis 18 on a first side thereof by a distance "D1." The tail section center of mass 24 is laterally spaced from the longitudinal axis 18 on a second side thereof by a distance "D2." The non-neutral positions of the head section center of mass 22 and the tail section center of mass shown in FIG. 5 produce respective rotational moments that are in opposition to each other. A head section rotational moment (MomentA), which equals MassA×D1, urges the toothbrush 2 to pivot toward a bristles down position in which the bristles 10 extend generally toward the support surface 20. A tail section rotational moment (MomentB), which equals MassB×D2, urges the toothbrush 2 to pivot toward a bristles up position. By designing the toothbrush 2 so that MomentB is larger than MomentA, a moment differential or imbalance is created that results in a net rotational moment (MomentNet) dominated by MomentB. MomentNet tends to induce the toothbrush 2 to pivot about the pivot point 16 to the bristles up position in which the bristles 10 extend vertically away from the support surface 20.

Designing the toothbrush 2 to produce a net rotational moment that induces pivoting to a bristles up position may be implemented by controlling the size and/or location of head section center of mass 22 and the tail section center of mass 24. In this regard, it should be understood that the head section center of mass 22 will be defined by all toothbrush structure that extends from the pivot point 16 to the distal end of the head section 4 (which may include a portion of the medial section 8). Similarly, the tail section center of mass 24 will be defined by all toothbrush structure that extends from the pivot point 16 to the distal end of the tail section 6 (which may include a portion of the medial section 8). In effect, the head section 4 and the tail section 6 meet at the pivot point 16. The medial section 8 may be thought of as representing the pivot point 16 and the regions of the head section 4 and the tail section 6 that lie on either side of the pivot point 16 and define the pivot surface 14.

If the head section center of mass 22 and the tail section center of mass 24 are on opposite sides of the longitudinal axis 18, the net rotational moment may be provided at least in part by spacing the tail section center of mass 24 further from the neutral pivot axis 18 than the head section center of mass 22. Alternatively, or in addition, the net rotational moment may be provided at least in part by making the tail section center of mass 24 heavier than the head section center of mass 22. Another way to create a favorable net rotational moment is to configure the toothbrush 2 so that the head section center of mass 22 is directly aligned with the longitudinal axis 18, so as to produce no head section rotational moment. Alternatively, as mentioned above, the toothbrush 2 could be configured so that the head section center of mass 22 and the tail section center of mass 24 are both on the same side of the longitudinal axis 18. This will be on the rearward side of the toothbrush 2, i.e., in the rearward direction 13 from the longitudinal axis 18.

The non-neutral location of the head section center of mass 22 in FIG. 5 is due largely to the weight of the bristles extending in the frontward direction 11 from their point of attachment to the structural portion of the head section 4. The location and weight of the head section center of mass 22 may thus be varied according to the size and weight of the bristles 10. The angle of the head section 4 is also a factor. In the bristles sideways position of FIG. 5, the structural portion of the head section 4 to which the bristles are attached is substantially aligned with the longitudinal axis 18. It will be appreciated that shifting the head section 4 rearwardly or frontwardly relative to the FIG. 5 position would shift the head section center of mass 22 toward or away from the neutral pivot axis 18, thereby varying the head section MomentA.

The non-neutral location of the tail section center of mass 24 is due to the rearward lateral asymmetry 12 of the tail section 6. It will be appreciated that the tail section's rearward lateral asymmetry 12 may be provided in various ways. For example, the asymmetry 12 may include some or all of the distal end of the tail section 6 being angled or curved rearwardly away from the longitudinal axis 18 when the toothbrush 2 is in the bristles sideways position of FIG. 5. As shown in FIG. 5, when the toothbrush 2 is in the bristles sideways position, the portion of the tail section 6 that merges with the medial section 8 may be situated on the longitudinal axis 18 or even extend frontwardly thereof. This is permissible so long as some other portion of the tail section 6, such as its distal end, extends rearwardly from the longitudinal axis 18.

Other configurations for establishing the location of the tail section center of mass are also possible. For example, recalling that the tail section center of mass 24 is defined by all toothbrush structure extending from the pivot point 16 to the distal end of the tail section 6 (which includes a portion of the medial section 8), the rearward lateral asymmetry could be formed closer to the pivot point than is shown in FIG. 5. In that case, there might be no asymmetry at the distal end of the tail section 6. Alternatively, as illustrated by the embodiment of FIG. 11 (described below), a toothbrush configuration could be provided that includes two (or more) rearward lateral asymmetries. Changing the weight of the tail section 6 is another way to adjust the tail section MomentB. This could be accomplished in various ways, such as using a different (e.g., more dense) material, adding ballast, etc.

A further design consideration for the toothbrush 2 is the positioning of its head and tail sections 4 and 6 relative to the support surface 20 when the toothbrush is resting on the support surface. This is referred to herein as head-tail bias. In FIG. 3, the toothbrush 2 is configured with a head-down bias in which only the pivot point 16 and a portion of the head section 4 touches the support surface 20 after the toothbrush comes to rest in the bristles up position. As shown in FIG. 4, the head-down bias may also exist during pivoting and rolling of the toothbrush 2, so long as this does not interfere with the rotation.

Figure 7:
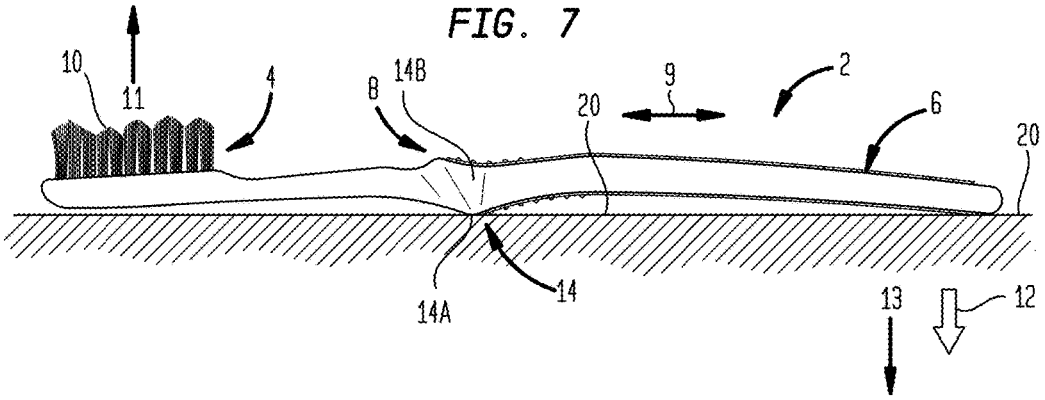
FIG. 7 is a side view of the toothbrush of FIG. 1 with the rear of the toothbrush resting on the support surface in a bristles up position, and with the toothbrush configured with a tail-down bias.

In another aspect, shown in FIG. 7, the toothbrush 2 may be configured with a tail-down bias in which only the pivot point 16 and a portion of the tail section 6 touches the support surface after the toothbrush comes to rest in the bristles up position. The tail-down bias may also exist during pivoting and rolling of the toothbrush 2, so long as this does not to interfere with the rotation.

Figure 8:
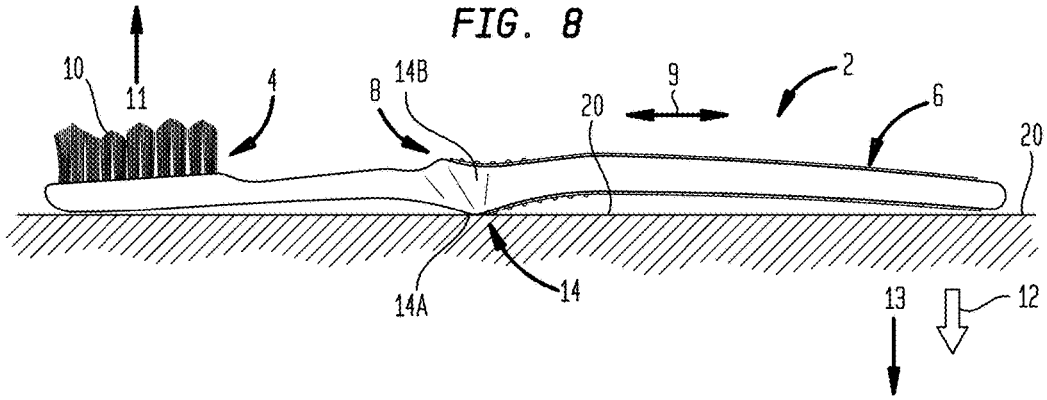
FIG. 8 is a side view of the toothbrush of FIG. 1 with the rear of the toothbrush resting on a support surface in a bristles up position, and with the toothbrush configured with a first type of neutral bias.
Figure 9:
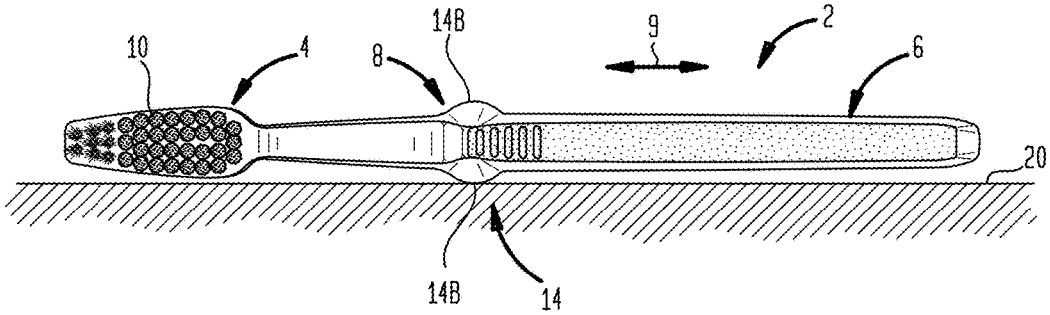
FIG. 9 is a side view of the toothbrush of FIG. 1 with a side edge of the toothbrush resting on the support surface in a non-bristles up position, and with the toothbrush configured with the first type of neutral bias.

In a further aspect, shown in FIG. 8, the toothbrush 2 may be configured with a first type of neutral bias in which neither the head section 4 nor the tail section 6 touches the support surface after the toothbrush comes to rest in the bristles up position. The first neutral bias may also exist during pivoting and rolling of the toothbrush 2, as shown in FIG. 9.

Figure 10:
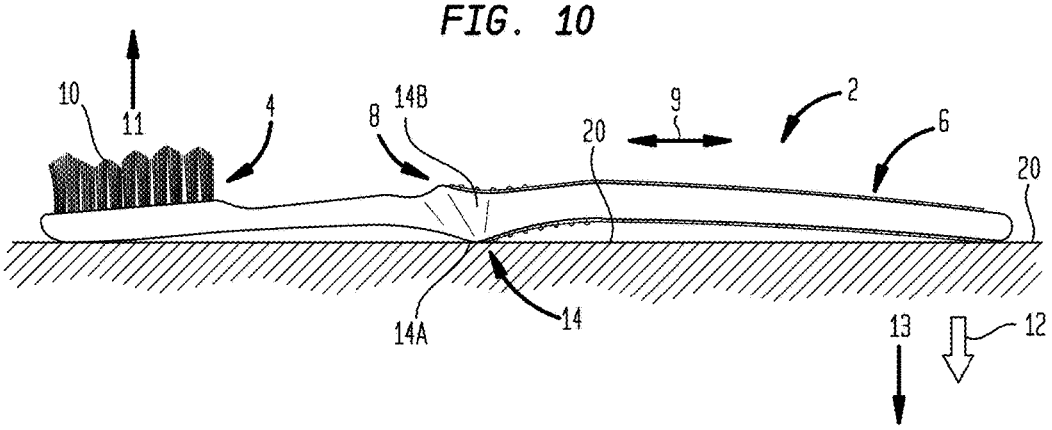
FIG. 10 is a side view of the toothbrush of FIG. 1 with the rear of the toothbrush resting on the support surface in a bristles up position, and with the toothbrush configured with a second type of neutral bias.

In a further aspect, shown in FIG. 10, the toothbrush 2 may be configured with a second type of neutral bias in which both the head section 4 and the tail section 6 touch the support surface after the toothbrush comes to rest in the bristles up position. During pivoting and rolling of the toothbrush 2, at least one of the head section 4 or the tail section 6 will typically not touch the support surface 20 so as not to interfere with the rotation. Alternatively, both the head section 4 and the tail section 6 could be allowed to touch the support surface 20 during pivoting and rolling, so long as such touching does not interfere with the rotation.

Turning now to FIGS. 11-18, another example embodiment of a self-righting toothbrush 102 is shown. The toothbrush 102 is similar in construction to the toothbrush 2 of FIGS. 1-10, and corresponding structure is indicated by corresponding reference numbers that have been incremented by 100. A principle difference between the toothbrushes 2 and 102 is that the latter has a modified medial section 108 in which the curved pivot surface 114 extends beyond the lateral protrusions 114B and onto the frontward side of the toothbrush. In particular, the pivot surface 114 includes a low-profile reference protrusion 114A on the rear side of the toothbrush 102, a pair of lateral protrusions 114B on the side edges of the toothbrush, and an enlarged primary protrusion 114D on the frontward side of the toothbrush 102. The primary protrusion 114D, the reference protrusion 114A and the lateral protrusions 114B are visually distinct from each other in all viewing orientations of the toothbrush by virtue of having respectively different cross-sectional (pivot surface) profiles, respectively different longitudinal profiles, and respectively different normal view configurations. In the illustrated embodiment, the pivot surface 114 has a substantially non-uniform edge thickness, and a non-ringlike appearance when the various protuberances are viewed in combination, making the toothbrush 102 more natural in appearance than certain prior art pivoting toothbrush designs.

The prior art toothbrush designs that feature pivot surfaces having a ringlike appearance include Doat (U.S. Pat. No. 7,007,335), Green (U.S. Pat. No. 2,722,703) and Gallo (U.S. Pat. No. 3,968,950). In each of these designs, the toothbrush has a distinct ring structure protruding from all sides of the toothbrush shaft. The ring structure has a well-defined pivot surface of substantially uniform edge thickness that extends continuously around the toothbrush shaft. The ring structure juts out sharply and dramatically from the longitudinally adjacent regions of the shaft, so that no side of the shaft would be considered to have a flowing gently-contoured longitudinal profile.

Figure 14:
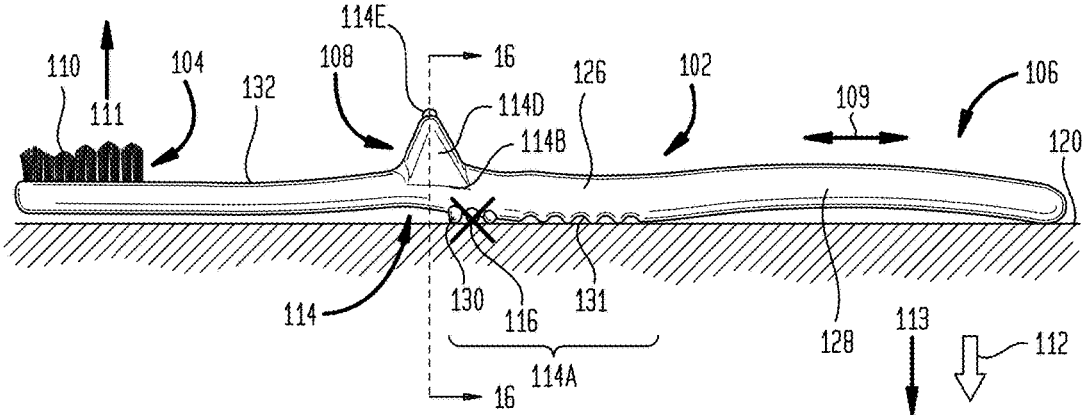
FIG. 14 is a side view of the toothbrush of FIG. 11 with the toothbrush positioned as in FIG. 12 with the rear of the toothbrush resting on the support surface in a bristles up position.
Figure 15:
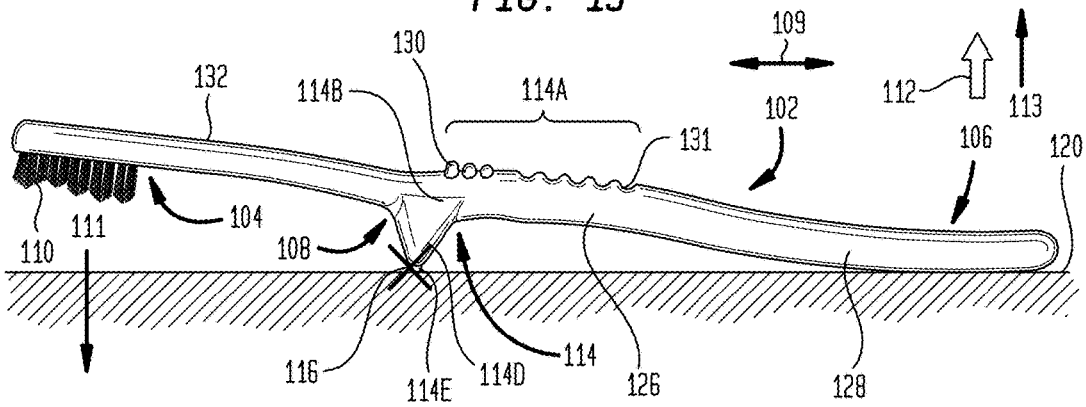
FIG. 15 is a side view of the toothbrush of FIG. 11 with the toothbrush resting on the support surface in a bristles down position.
Figure 17:
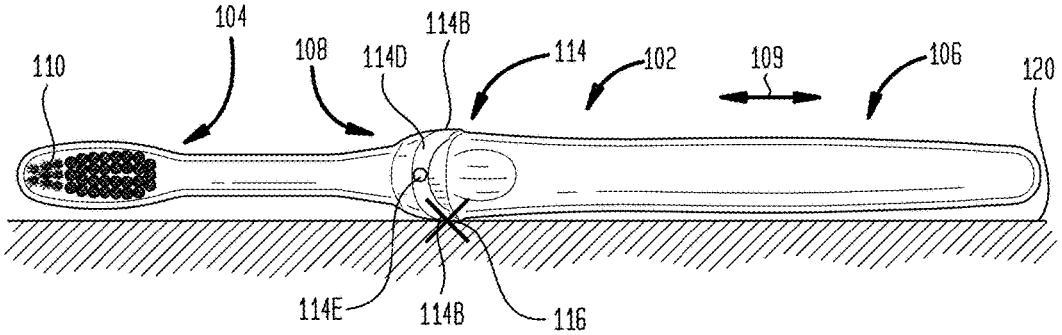
FIG. 17 is a side view of the toothbrush of FIG. 1 with a side edge of the toothbrush resting on the support surface in a non-bristles up position.

As shown in FIGS. 15 and 17, the primary protrusion 114D and the lateral protrusions 114B will contact the support surface 120 during rolling of the toothbrush 102. As shown in FIG. 14, the reference protrusion 114A will contact the support surface 120 following rolling of the toothbrush 102. Hence, the reference protrusion 114A, which is substantially lower in height and cross-sectionally flatter than the primary protrusion 114D, defines a stable reference or rest position of the toothbrush 102.

Figure 16:
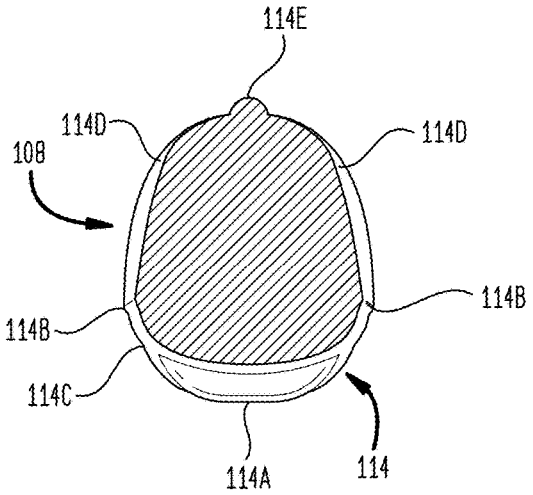
FIG. 16 is a cross-sectional view taken along line 16-16 in FIG. 14.

The pivot surface profile of the various protrusions is depicted by the cross-sectional view of FIG. 16. The longitudinal profile and normal view configuration of the various protrusions is shown by various other drawing figures. For the primary protrusion 114D, its longitudinal profile is exemplified by the side view of FIG. 14 and its normal view configuration is exemplified by the top view of FIG. 12. For the reference protrusion 114A, its longitudinal profile is exemplified by the side view of FIG. 14 and its normal view configuration is exemplified by the bottom view of FIG. 13. For the lateral protrusions 114B, its longitudinal profile is exemplified by the top and bottom plan views of FIGS. 12 and 13, and its normal view configuration is exemplified by the side view of FIG. 14.

In terms of pivot surface profile, the primary protrusion 114D is tall and dome-shaped. In comparison to the primary protrusion 114D, the pivot surface profiles of the reference protrusion 114A and the lateral protrusions 114B are substantially lower in height and cross-sectionally flatter.

In terms of the longitudinal profile, the primary protrusion 114D is sharply angled and configured with a well-defined ridge or peak that extends substantially above longitudinally adjacent surface portions of the toothbrush shaft. It is sized so that neither the bristles 110 nor any other portion of the toothbrush head section 104 will contact a horizontal support surface 120 when the toothbrush 102 is in the bristles down position (as shown in FIG. 15). In comparison to the primary protrusion 114D, the longitudinal profiles of the reference protrusion 114A and the lateral protrusions 114B are substantially lower in height and flatter. They may also be longitudinally diffuse. Apart from the optional provision of finger-receiving surface texture features on the reference protrusion 114A, neither the reference protrusion nor the lateral protrusions require sharp ridges, peaks or other well-defined pivot surface prominences to provide a functioning pivot surface.

In terms of normal view configuration, the primary protrusion 114D is generally crescent-shaped. By comparison, the normal view configuration of the reference protrusion 114A includes a generally bell-shaped head end and may optionally include a narrower tail end. Surface texture elements may be optionally provided thereon, but the surface could also be made smooth if desired. The normal view configuration of the lateral protrusions 114B is that of a transverse shaft having one side that merges with a widened base portion of the primary protrusion 114D and another side that merges with the reference protrusion 114A.

A further feature of the toothbrush 102 is that the head section 104, or at least the distal end thereof that mounts the bristles, never touches the support surface 120 in any rotational position of the toothbrush. This may be achieved with or without the toothbrush 102 having a tail down bias wherein the tail section 106 touches the support surface 120. For example, as described in more detail below, the reference protrusion 114 may be longitudinally distributed so as to have at least two points of contact that can maintain the head section 104 above the support surface 120 even without the tail section 106 touching the support surface.

As can be seen in FIG. 16, the primary protrusion 114D may have a substantially elongated, generally dome-shaped cross-sectional configuration that provides a corresponding highly-rounded pivot surface profile. As can be seen in FIGS. 14 and 15, the primary protrusion 114D may have a generally triangularly shaped side view configuration that provides a corresponding longitudinal surface profile having a relatively wide lower base portion that tapers to a relatively thin terminal portion. As noted above, and as can be seen in FIGS. 11, 12 and 17, the primary protrusion 114D is generally crescent-shaped in its plan view orientation. It may have a convex configuration on a head-facing side thereof that faces the head section 104 of the toothbrush 102, and a concave configuration on a tail-facing side that faces the tail section 106 of the toothbrush. Advantageously, the concave configuration of the tail-facing side of the primary protrusion 114D may be used to accommodate the end of a toothbrush user's thumb while brushing the teeth. The primary protrusion 114D also aids in preventing liquid material present at the head end of the toothbrush 102 from dripping onto the user's hand during teeth brushing.

In the event that the toothbrush 102 is placed on the support surface 120 with the bristles 110 oriented anywhere below horizontal (i.e., below parallel to the support surface), the medial section 108 of the toothbrush will come into contact with the support surface 120 at a pivot point 116 that lies somewhere on the primary protrusion 114D. Due to pivot surface profile provided by its generally dome-shaped configuration, the primary protrusion 114D allows the toothbrush 102 to undergo pivoting so as to roll on the support surface 120.

If desired, an optional protuberance 114E of relatively small size may be formed on the central peak of the primary protrusion 114D. The protuberance 114E represents a localized discontinuity that interrupts the otherwise smooth curvature of the cross-sectional (pivot surface) profile of the primary protrusion 114D. This provides instability to minimize the possibility that the toothbrush 102 becomes balanced in the strictly bristles down position shown in FIG. 15. That such balancing might otherwise occur can be seen from FIG. 13. In this position, the head section center of mass 122 (Mass "A") and the tail section center of mass 124 (Mass "B") both lie substantially vertically in line with the longitudinal axis 118 that is aligned with the pivot point 116 and extends perpendicularly to the direction of toothbrush rolling.

As can be seen in FIG. 16, with the protuberance 114E present on the primary protrusion 114D, the entire pivot surface 114 may have an acorn-like cross-sectional shape. However, it will be appreciated that many other shapes could be used when configuring the medial section 108, including shapes with or without the protuberance 114E.

A further feature of the toothbrush embodiment 102 shown in FIG. 11 is that the reference protrusion 114A may be implemented as a finger pad region of the shaft of the toothbrush 102. This finger pad region region has a substantially flat and longitudinally diffuse face whose entire surface accommodates a user's fingers being placed thereon during normal use of the toothbrush 102 to brush the user's teeth. As used herein, the term "substantially flat" means the overall lateral and longitudinal profile exclusive of any local surface texturing (such as the lateral ridges 130 or the lateral channels 131 shown in FIGS. 14, 15 and 18 and discussed below). As used herein, the term "longitudinally diffuse" refers to the fact that the reference protrusion 114A is distributed in the longitudinal direction.

In addition to being substantially flat, the reference protrusion 114A in the illustrated embodiment is also substantially flush with the longitudinally adjacent surface areas of the rearward side of the toothbrush 102. As used herein, the term "substantially flush" means the overall longitudinal profile exclusive of any local surface texturing (such as the lateral ridges 130 or the lateral channels 131 shown in FIGS. 14, 15 and 18 and discussed below). The finger pad defined by the reference protrusion 114A may thus represent a non-raised portion of the shaft of the toothbrush 102. It would also be possible to slightly raise the reference protrusion 114A from the adjacent surface areas of the rearward side of the toothbrush 102, such that the finger pad defined thereby represents a visibly raised portion of the shaft of the toothbrush 102, albeit still substantially flat (barring any surface texturing thereon).

The reference protrusion 114A may be defined by the medial section 108 of the toothbrush 102 being formed with a slightly rearward lateral asymmetry 126. In the illustrated embodiment, the rearward asymmetry 126 represents a gradually rearwardly curved longitudinal span beginning just behind the primary protrusion 114D and extending some distance toward the distal end of the tail section 106. This rearward lateral asymmetry 126 can be seen in FIGS. 14 and 18. It starts proximate to the cross-section 16-16 of FIG. 14 (but is longitudinally spaced therefrom) and extends to the right end of the bracket that identifies the span of the reference protrusion 114A. At the tail end of the reference protrusion 114A, the toothbrush may have a slight frontward asymmetry 128 before resuming a rearwardly angled orientation to provide the rearward lateral asymmetry 112. In the illustrated embodiment, the frontward asymmetry 128 represents a gradually frontwardly curved longitudinal span beginning just behind the rearward asymmetry 126 and extending some distance toward the distal end of the tail section 106. Both of the asymmetries 126 and 112 contribute to shifting the tail section 106 and its center of mass 124 in the rearward direction 113. It will be appreciated that the longitudinal extent of the rearward protrusion 114A is a matter of design choice, and may be varied according to the desired look of the toothbrush 102.

Figure 13:
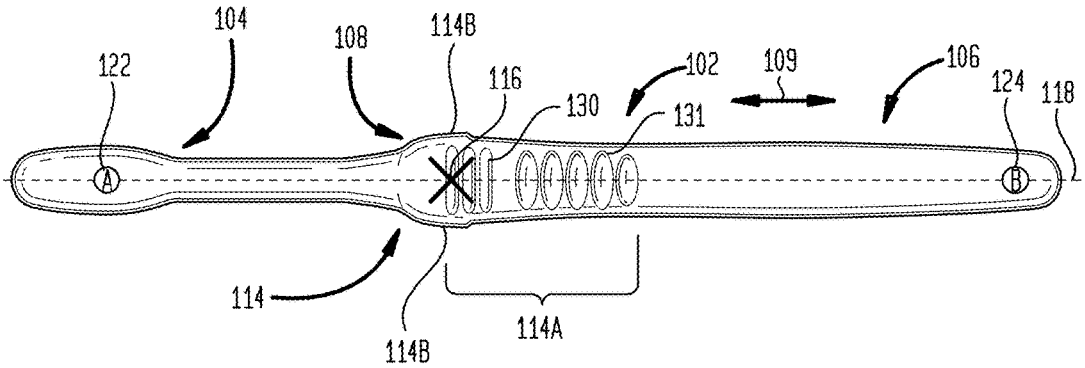
FIG. 13 is a plan view showing the rear of the toothbrush of FIG. 11 with the front of the toothbrush resting on the support surface in a bristles down position.

As shown in FIGS. 13-15 and 18, the reference protrusion 114A may include a set of ridges 130 and/or a set of channels 131 that are oriented laterally and centered between the lateral edges of the toothbrush 102. Any one or more of the ridges 130 may provide part of the actual pivot surface 114 that contacts the support surface 120. The ridges 130 may be optionally provided if it is desired to increase the height of the rearward protrusion 114A without increasing the overall thickness or curvature of the toothbrush 102 in this vicinity. This represents one way in which the height of the finger pad defined by the reference protrusion 114A may be raised relative to the adjacent surfaces of the shaft of the toothbrush 102. Another approach would be to provide a raised pad whose entire surface is raised without the use of ridges or other localized features. The ridges 130 and channels 131 provide a gripping surface that may be used as a forefinger grip by a toothbrush user during brushing. As can be seen in FIG. 13, the ends of the ridges 130 and the channels 131 may be spaced laterally inwardly from the side edges of the shaft of the toothbrush 102, and the ridges and channels themselves may be spaced from each other in the longitudinal direction. This means that the reference protrusion 114A may include localized discontinuities that interrupt the otherwise smooth curvature of the cross-sectional (pivot surface) profile of the reference protrusion 114A.

As can be seen in FIG. 16, the reference protrusion 114A has a cross-sectional (pivot surface) profile that is substantially flat as compared to the cross-sectional (pivot surface) profile of the primary protrusion 114D. This further contributes to the acorn-like cross-sectional shape of the overall pivot surface 114. Making the pivot surface profile of the rearward protrusion 114A substantially flat helps stabilize the toothbrush 102 in the bristles up position and prevents excessive rocking as the toothbrush assumes that position. In addition to the substantial flatness of the pivot surface profile of the reference protrusion 114A the entire surface curvature of the finger pad region may be substantially flat in both the longitudinal and lateral directions of the toothbrush 102.

Figure 12:
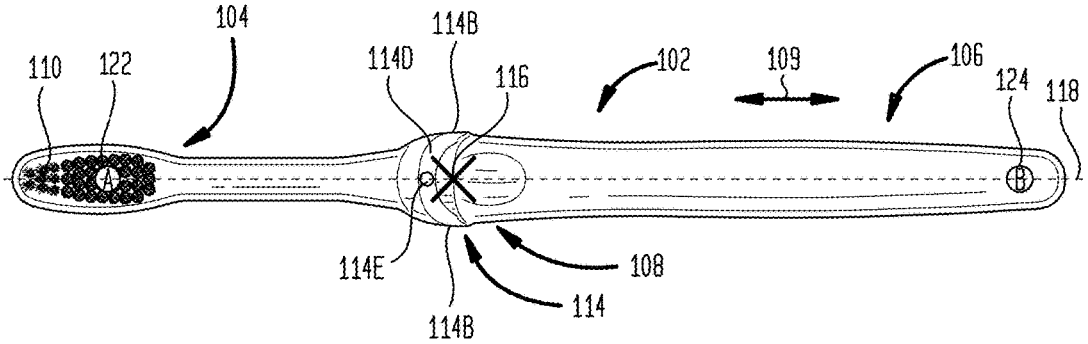
FIG. 12 is a plan view showing the front of the toothbrush of FIG. 11 with the rear of the toothbrush resting on a horizontal support surface in a bristles up position.

As a result, the reference protrusion 114A does not appear to be part of the primary protrusion 114D, and the primary protrusion does not appear to be part of the reference protrusion. This configuration feature is aided by the fact that the lateral protrusions 114B are themselves longitudinally diffuse and relatively flat, and do not require sharply defined ridges, peaks or other pivot surface prominences to provide a functioning pivot surface (although such may be provided if desired). As shown in FIGS. 14 and 15, it may appear from the side of the toothbrush 102 as if there are no lateral protrusions at all, merely a smooth continuous edge of the toothbrush shaft. As shown in FIGS. 12 and 13, the lateral protrusions may be defined on the lateral edges of the shaft of the toothbrush 102 as a locally widened area of the the shaft. The height of the lateral protrusions 114B as compared to the longitudinally adjacent surface areas of the toothbrush shaft, which defines the local widening of the shaft, is a matter of design choice. In the illustrated embodiment, the lateral protrusions 114B are only slightly raised. In other embodiments, the lateral protrusions 114B need not be raised at all, and could instead simply represent a gradual widening of the toothbrush shaft. If desired, either one or both of the longitudinally adjacent portions of the shaft may be of the same width as the lateral protrusions 114B. The apparent longitudinal extent of the lateral protrusions 114B may thus correspondingly vary, and is a matter of design choice.

As shown in FIGS. 14 and 15, the formation of the lateral protrusions 114B as longitudinally diffuse and substantially flat creates a configuration in which the widened base of the primary protrusion 114D merges into and terminates at the lateral edges of the toothbrush 102. Correspondingly, there may be no visible continuity between the primary protrusion 114D and the reference protrusion 114A, and may appear as if these portions of the pivot surface are interrupted by the transverse toothbrush lateral edges, and are disjoint and unrelated to each other. When the toothbrush 102 is viewed from the side, the shaft of the toothbrush 102 may appear to extend through a rearward side of the medial section 108. The entire pivot surface 114 may appear to be formed on only the frontward side of the toothbrush, with the rearward side being of conventional toothbrush design due to the reference protrusion 114A being substantially flush with longitudinally adjacent surface portions of the rearward side.

The reference protrusion 114A may thus represent a stealth protrusion that assists in maintaining the toothbrush 102 in its stability position, yet is perceived as a conventional gripping region of the toothbrush 102. The reference protrusion 114A may be seen as being part of a longitudinally distributed surface of the medial section 108. To further create the effect of the pivot surface 114 being formed on only one side of the toothbrush 102, the primary and reference protrusions 114D and 114A may be configured so that no portions thereof are wider than the lateral edges of the toothbrush where the lateral protrusions 114B are formed. This will likewise ensure that the widened base of the primary protrusion 114D is defined to merge into and terminates at the lateral edges of the toothbrush shaft 102.

Because of the ability to configure the entire rearward side of the toothbrush 102 to resemble a conventional toothbrush, a toothbrush manufacture may adorn the rearward side with standard surface texture elements such as the ridges 130 and the channels 131, particularly in the area of the rearward protrusion 114A. Other surface texture elements, such as rubberized grip members, could also be provided. Alternatively, the rearward side of the toothbrush 102, including the reference protrusion 114A, need not have any surface texture elements, and could instead be completely smooth. The reference protrusion 114A and the longitudinally distributed surface of which it is a part, thus provide a region of manufacturing discretion for defining any desired surface features that enhances toothbrush usage or appearance. This is in contrast to prior art pivoting toothbrush designs that use ringlike pivot surfaces that disrupt the natural surface contour of the toothbrush shaft on all sides thereof, and thereby restrict manufacturing discretion because the ringlike structure cannot be removed.

Regardless whether or not the reference protrusion 114A includes surface texturing, the substantially flat configuration of its defined finger pad region will lie on a side of the toothbrush 102 that is opposite from the side that defines the primary protrusion 114D. As previously noted, the entire surface of the substantially flat face of this finger pad region accommodates a user's fingers during normal use of the toothbrush to brush the user's teeth. The primary protrusion 114D may simultaneously support the tip of the user's thumb.

As shown in FIG. 14, the toothbrush 102 is in a stable reference orientation with the bristles 110 extending upwardly in a vertical direction when the toothbrush is disposed with the reference protrusion 114A contacting the support surface 120. This stable reference orientation represents the toothbrush 102 being in the bristles up position by virtue of the fact that the reference protrusion 114A is defined on the rearward side of the toothbrush. The toothbrush 102 is in an unstable position, and susceptible to rolling toward the stable orientation, when the toothbrush is in a non-bristles down position. The instability positions of the toothbrush 102 include the toothbrush being in a vertical bristles down position, or with the bristles extending in any non-vertical direction.

As previously noted, the primary protrusion 114D may be sized so that neither the bristles 110 nor any other portion of the head section 104 contacts the support surface 120 when the toothbrush 102 is in the bristles up position. In a similar vein, the entire pivot surface 114 may be designed so that no portion of the head section 104, including the bristles 110, touches the support surface 120 at any rotational position of the toothbrush. This "no-touch" property is illustrated by FIGS. 14, 15 and 17 of the drawings.

FIG. 14 shows the reference protrusion 114A enabling the distal end of the head section 104 to be raised off the support surface 120 when the toothbrush 102 is in the bristles up position. If the reference protrusion 114A raises the distal end of the head section 104 high enough, the base portion of the head section 104 that extends from the pivot point 116 may be angled slightly rearwardly. This is shown in FIG. 14, with the base portion of the head section 104 being labeled by reference number 132. Providing the head section base portion 132 with a rearward angle correspondingly shifts the head section center of mass 122 in the rearward direction. As described below in connection with FIG. 18, this may advantageously result in the head section center of mass 122 being aligned with the longitudinal axis 118 in the bristles sideways position of FIG. 18, such that the head section center of mass offers no resistance to pivoting/rolling to the bristles up position. By further angling the head section base portion 132 in the rearward direction, it may be possible to shift the head section center of mass 122 so that it lies on the same side of the longitudinal axis 118 as the tail section center of mass 124. In that case, both centers of mass would induce pivoting/rolling to the bristles up position.

It should be understood that the tail section's rearward lateral asymmetry 126 and/or the ridges 130 of the reference protrusion 114A may be reduced in size or even eliminated. In that case, the head section base portion 132 may be configured with a slight frontward angle if it is desired to prevent the distal end of the head section 104 from touching the contact surface 120.

Figure 18:
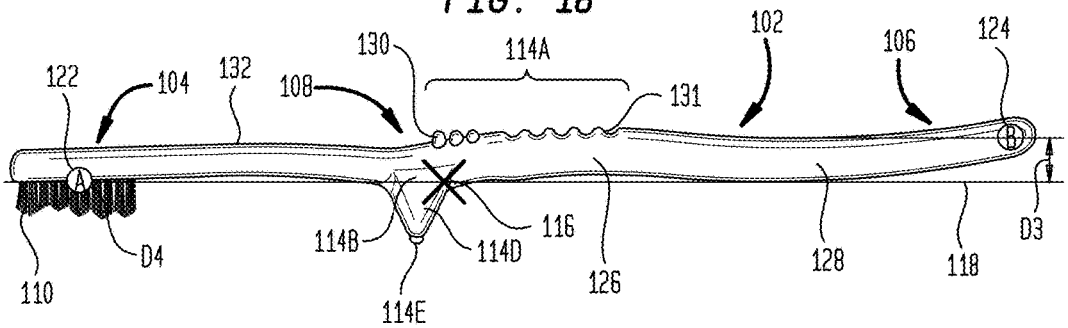
FIG. 18 is a plan view of the toothbrush of FIG. 1 positioned as in FIG. 17 with a side edge of the toothbrush resting on the support surface in a non-bristles up position.

Turning now to FIG. 18, the toothbrush 102 is shown in a non-bristles up position in which the bristles are oriented generally horizontally. In this bristles sideways position, the tail section center of mass 124 assumes a non-neutral unstable position in which it is not vertically in line with the longitudinal axis 118. In particular, the tail section center of mass 124 is laterally spaced from the longitudinal axis 118 by a distance "D3." The head section center of mass 122 is shown in FIG. 18 as being in line with the longitudinal axis, such that its spacing distance "D4"=0. In this configuration, the head section rotational moment (MomentA), which equals MassA×D4, is zero and has no effect on toothbrush rotation in the position shown in FIG. 18. The tail section rotational moment (MomentB), which equals MassB×D3, urges the toothbrush 102 to pivot toward the bristles up position.

The foregoing configuration is for purposes of example only, and it will be understood that the head section center of mass 122 could also be laterally offset from the longitudinal axis 118, either on the same or opposite side as the tail section center of mass 124. As long as the tail section MomentB is larger than the head section MomentA, and remains so as the toothbrush 102 pivots and rolls, the toothbrush will rotate from a non-bristles up position to a bristles up position.

FIGS. 19A-H and 20A-H illustrate this condition being satisfied as the toothbrush pivots and rolls through different positions on the support surface 120. During such rotation, the rotational moments induced by the head section center of mass 122 and the tail section center of mass 124 will change, but the head section MomentA is always less than the tail section MomentB. FIGS. 19A-H are end views of the toothbrush 102 looking toward the head section 104. For clarity, the bristles 110 are not shown. FIGS. 20A-H are end views of the toothbrush 102 looking toward the tail section 106.

FIGS. 19A-C and 20A-C show a first rotational sequence in which the toothbrush 102 starts from a bristles sideways position and ends in a bristles up position. FIGS. 19D-H and 20D-H show a second rotational sequence in which the toothbrush 102 starts from a bristles down position, passes through a bristles sideways position, and ends in a bristles up position.

Figure 19A:
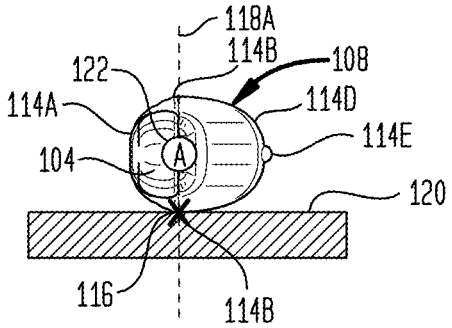
FIGS. 19A-19H are end views taken from the head end of the toothbrush of FIG. 12 and showing different rotational positions of the toothbrush about a central axis of rotation.
Figure 20A:
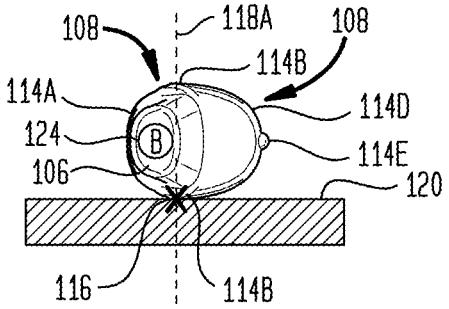
FIGS. 20A-20H are end views taken from the tail end of the toothbrush of FIG. 12 and showing different rotational positions of the toothbrush about a central axis of rotation.

FIGS. 19A and 20A depict the toothbrush 102 in a bristles sideways position as exemplified by FIG. 18. If the bristles were depicted in FIG. 19A, they would extend extend from the head section 104 in the right-hand direction and would be parallel to the support surface 120. The medial section 108 contacts the support surface 120 at a pivot point 116 located at one of the lateral protrusions 114B. As shown in FIG. 19A, the head section center of mass 122 lies substantially in a vertical plane 118A that extends through the longitudinal axis 118 (and the pivot point 116), such that the head section MomentA is approximately zero. As shown in FIG. 20A, the tail section center of mass 124 is laterally spaced from the vertical plane 118A on the left side thereof, such that the tail section MomentB is a non-zero value tending to impart counterclockwise rotation to the toothbrush 102 so that it is urged to roll toward the bristles up position.

Figure 19B:
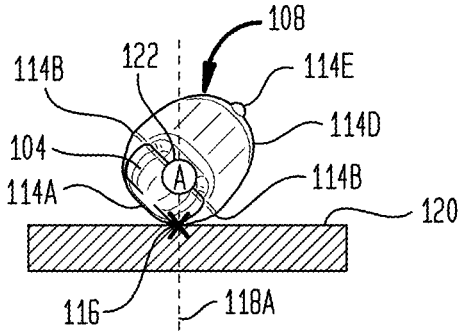
Figure 20B:
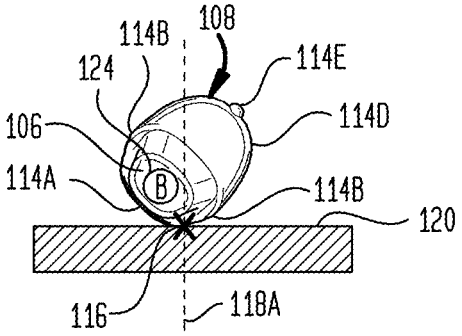

FIGS. 19B and 20B depict the toothbrush 102 in a non-bristles up position after rotating 45 degrees in the counterclockwise direction from the bristles sideways position shown in FIGS. 19A and 20A. If the bristles were depicted in FIG. 19B, they would extend from the head section 104 at a 45 degree angle. The medial section 108 contacts the support surface 120 at a pivot point 116 located between the reference protrusion 114A and the lateral protrusion 114B that contacted the support surface in FIGS. 19A and 20A. As shown in FIG. 19B, the head section center of mass 122 lies substantially in the vertical plane 118A, such that the head section MomentA is approximately zero. As shown in FIG. 20B, the tail section center of mass 124 is laterally spaced from the vertical plane 118A on the left side thereof, such that the tail section MomentB is a non-zero value tending to impart counterclockwise rotation to the toothbrush 102 so that it is urged to roll toward the bristles up position.

Figure 19C:
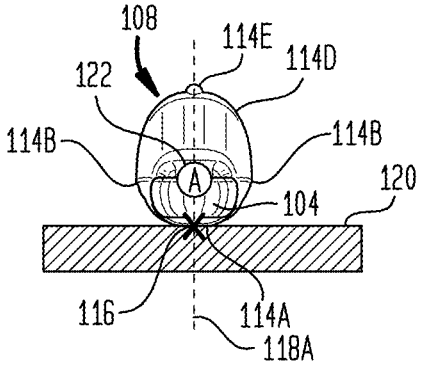
Figure 20C:
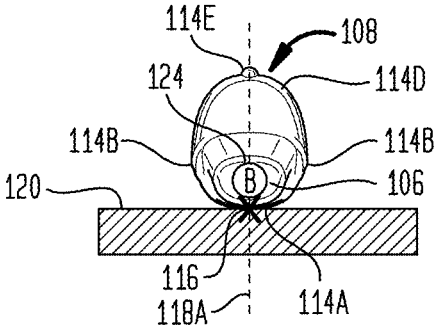

FIGS. 19C and 20C depict the toothbrush 102 in a bristles up position as exemplified by FIG. 14 after rotating 45 degrees in the counterclockwise direction from the position shown in FIGS. 19B and 20B. If the bristles were depicted in FIG. 19C, they would extend from the head section 104 in the vertical upward direction and perpendicular to the support surface 120. The medial section 108 contacts the support surface 120 at a pivot point 116 located at the reference protrusion 114A. As shown in FIG. 19C, the head section center of mass 122 lies substantially in the vertical plane 118A, such that the head section MomentA is zero. As shown in FIG. 20C, the tail section center of mass 124 also lies substantially in the vertical plane 118A, such that the tail section MomentB is likewise zero. The toothbrush 102 is rotationally stable and will remain in the bristles up position.

Figure 19D:
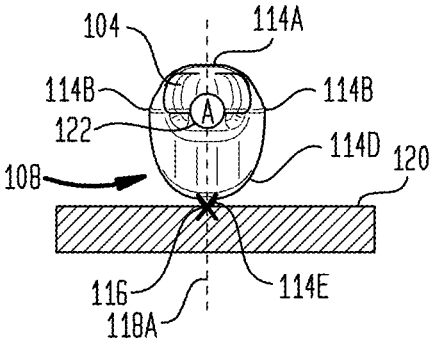
Figure 20D:
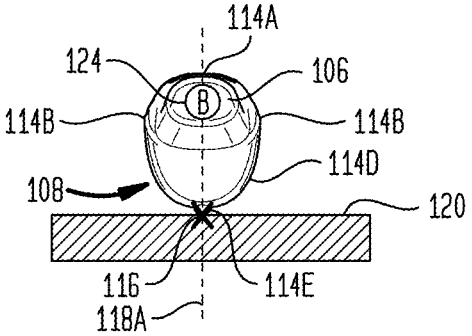

FIGS. 19D and 20D depict the toothbrush 102 in a bristles down starting position as exemplified by FIG. 15. If the bristles were depicted in FIG. 19D, they would extend from the head section 104 in the vertical downward direction and would be perpendicular to the support surface 120. The medial section 108 contacts the support surface 120 at a pivot point 116 located at the tip of the protuberance 114E on the primary protrusion 114D. As shown in FIG. 19D, the head section center of mass 122 lies substantially in the vertical plane 118A, such that the head section MomentA is zero. As shown in FIG. 20D, the tail section center of mass 124 also lies substantially in the vertical plane 118A, such that the tail section MomentB is likewise zero. The toothbrush 102 is rotationally unstable due to the raised position of the head section center of mass 122 and the tail section center mass 124 (relative to their positions in the stable position of FIGS. 19C and 20C). Any slight rotation of the toothbrush 102 from the position of FIGS. 19D and 20D will laterally offset the head section center of mass 102 and the tail section center of mass 104 from the vertical plane 118A, immediately creating a rotational moment that induces toothbrush rotation. This is in contrast to the stable position of FIGS. 19C and 20C, in which any slight rotation of the toothbrush 102 is countered by an opposing rotational moment imparted by the tail section center of mass 124. As previously discussed, the rotational instability of the toothbrush in the position of FIGS. 19D and 20D is further assisted by the protuberance 114E.

Figure 19E:
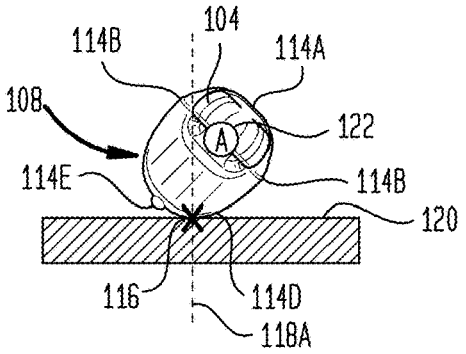
Figure 20E:
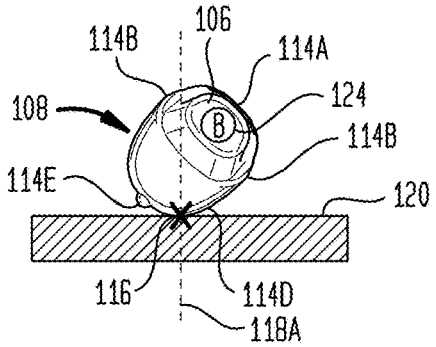

FIGS. 19E and 20E depict the toothbrush 102 in a non-bristles up position after rotating 45 degrees in the clockwise direction from the bristles down position shown in FIGS. 19D and 20D. If the bristles were depicted in FIG. 19E, they would extend from the head section 104 at a 225 degree angle. The medial section 108 contacts the support surface 120 at a pivot point 116 located between the primary protrusion 114D and one of the lateral protrusions 114B. As shown in FIG. 19E, the head section center of mass 122 is offset from the vertical plane 118A on the right side thereof, such that the head section MomentA is a non-zero value tending to impart clockwise rotation to the toothbrush so that it is urged to roll toward the bristles up position. As shown in FIG. 20E, the tail section center of mass 124 is laterally spaced from the vertical plane 118A on the right side thereof, such that the tail section MomentB is a non-zero value also tending to impart clockwise rotation to the toothbrush 102 so that it is urged to roll toward the bristles up position.

Figure 19F:
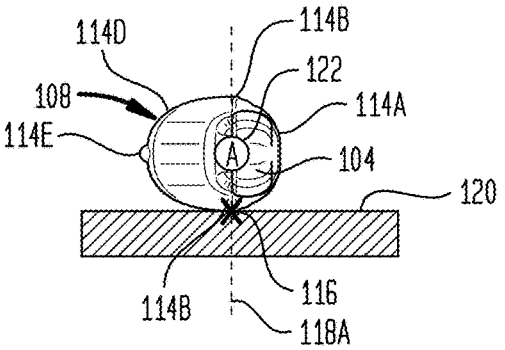
Figure 20F:
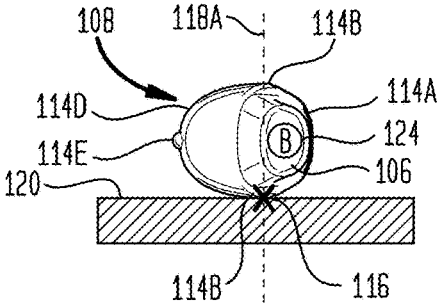

FIGS. 19F and 20F depict the toothbrush 102 in a bristles sideways position as exemplified by FIG. 18. If the bristles were depicted in FIG. 19F, they would extend extend from the head section 104 in the left-hand direction and would be parallel to the support surface 120. The medial section 108 contacts the support surface 120 at a pivot point 116 located at one of the lateral protrusions 114B. As shown in FIG. 19F, the head section center of mass 122 lies substantially in the vertical plane 118A, such that the head section MomentA is approximately zero. As shown in FIG. 20F, the tail section center of mass 124 is laterally spaced from the vertical plane 118A on the right side thereof, such that the tail section MomentB is a non-zero value tending to impart clockwise rotation to the toothbrush 102 so that it is urged to roll toward the bristles up position.

Figure 19G:
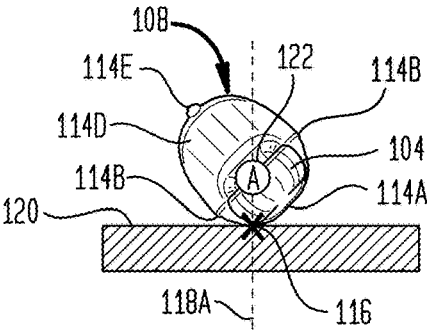
Figure 20G:
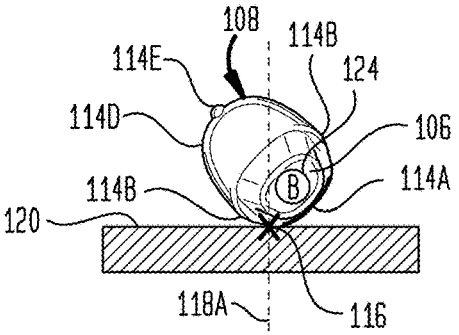

FIGS. 19G and 20G depict the toothbrush 102 in a non-bristles up position after rotating 45 degrees in the clockwise direction from the bristles sideways position shown in FIGS. 19F and 20F. If the bristles were depicted in FIG. 19G, they would extend from the head section 104 at a 135 degree angle. The medial section 108 contacts the support surface 120 at a pivot point 116 located between the reference protrusion 114A and the lateral protrusion 114B that contacted the support surface in FIGS. 19F and 20F. As shown in FIG. 19G, the head section center of mass 122 lies substantially in the vertical plane 118A, such that the head section MomentA is approximately zero. As shown in FIG. 20G, the tail section center of mass 124 is laterally spaced from the vertical plane 118A on the right side thereof, such that the tail section MomentB is a non-zero value tending to impart clockwise rotation to the toothbrush 102 so that it is urged to roll toward the bristles up position.

Figure 19H:
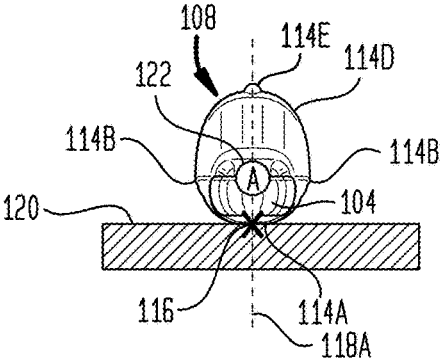
Figure 20H:
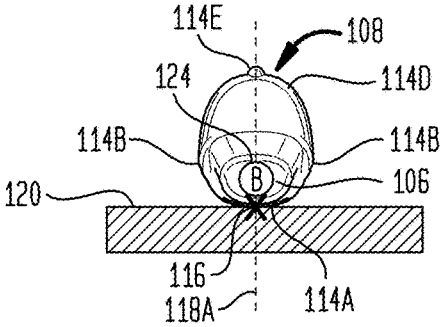

FIGS. 19H and 20H depict the toothbrush 102 in a bristles up position as exemplified by FIG. 14 after rotating 45 degrees in the clockwise direction from the position shown in FIGS. 19G and 20G. If the bristles were depicted in FIG. 19H, they would extend from the head section 104 in the vertical upward direction and perpendicular to the support surface 120. The medial section 108 contacts the support surface 120 at a pivot point 116 located at the reference protrusion 114A. As shown in FIG. 19H, the head section center of mass 122 lies substantially in the vertical plane 118A, such that the head section MomentA is zero. As shown in FIG. 20H, the tail section center of mass 124 also lies substantially in the vertical plane 118A, such that the tail section MomentB is likewise zero. The toothbrush 102 is rotationally stable and will remain in the bristles up position.

Figure 21:
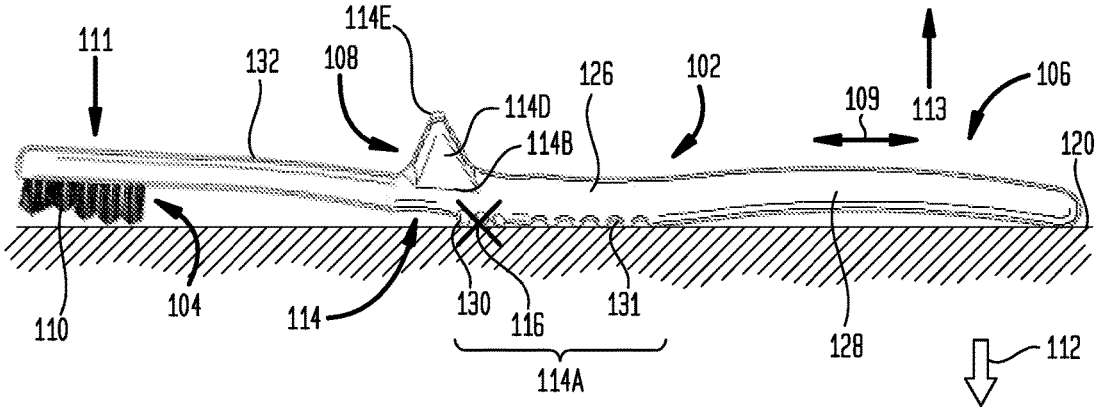
FIG. 21 is a side view showing another example embodiment of a self-righting toothbrush that may be constructed in accordance with the present disclosure, with the toothbrush resting on the support surface in a bristles down position.

Turning now to FIG. 21, the toothbrush 102 could be modified so that the low-profile reference protrusion 114A is formed on the frontward side 111 of the toothbrush, and the enlarged primary protrusion 114D is on the rearward side 113 of the toothbrush. In this embodiment, the toothbrush 102 is in a stable orientation with the bristles 110 extending downward in a vertical direction when the toothbrush is disposed with the reference protrusion 114A contacting the support surface 120. This stable orientation represents the toothbrush 102 being in a bristles down position by virtue of the fact that the reference protrusion 114A is defined on the frontward side of the toothbrush. The toothbrush 102 is in an unstable position and susceptible to rolling toward the stable orientation when the toothbrush is in a non-bristles down with the bristles extending either vertically upwardly or in any non-vertical direction. As in the case of the embodiment of FIGS. 14-18, no portion of the toothbrush head section 104, including the bristles 110, will contact the support surface 120 during any rolling position of the toothbrush 102.

As may be further seen in FIG. 21, the reference protrusion 114A of this embodiment is configured as a finger pad region of the shaft of the toothbrush 102 having a substantially flat face whose entire surface accommodates a user's thumb when the toothbrush is used to brush the user's teeth. The primary protrusion 114D may simultaneously support the side of user's index finger.

Figure 22:
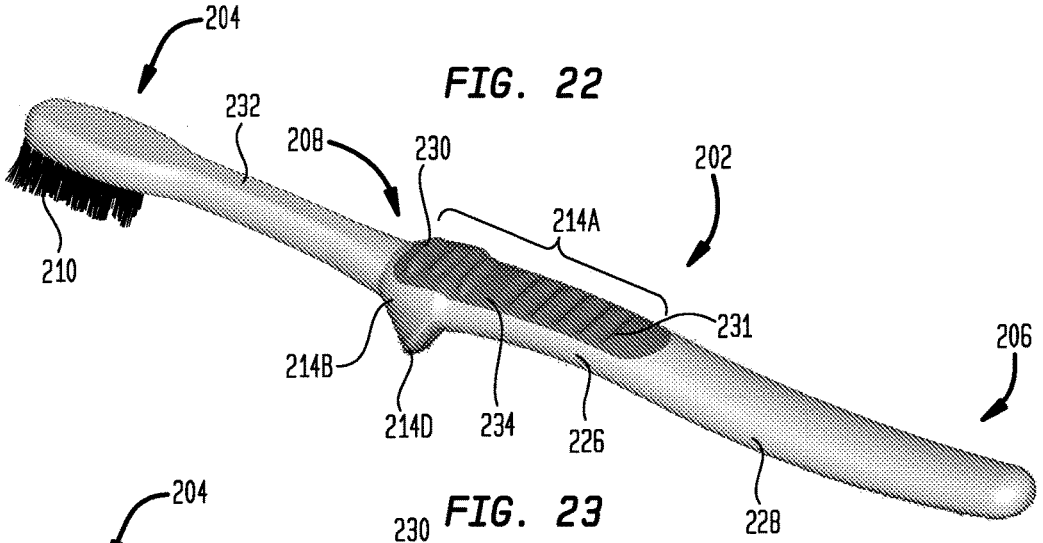
FIG. 22 is a perspective view showing another example embodiment of a self-righting toothbrush that may be constructed in accordance with the present disclosure, with the toothbrush including an external ballast.
Figure 23:
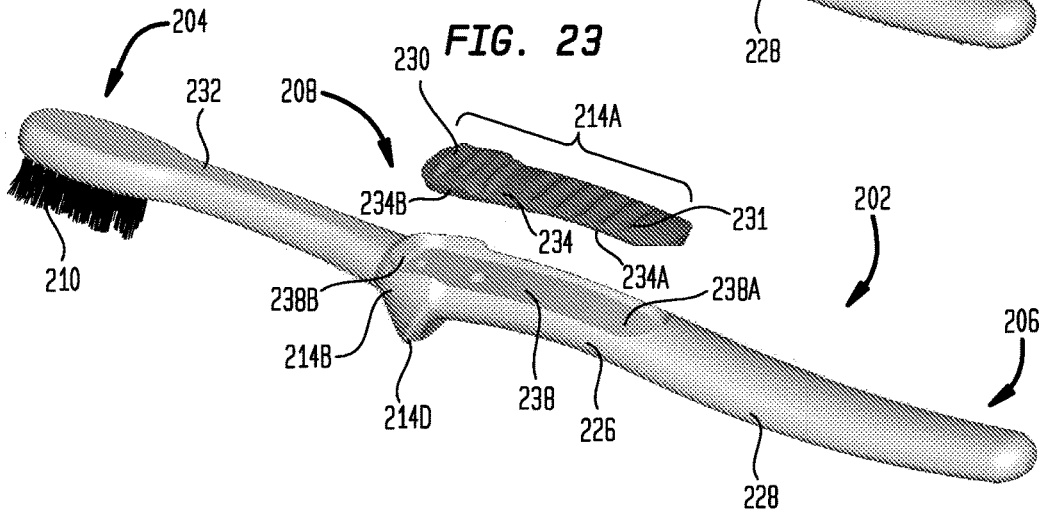
FIG. 23 is an exploded perspective view showing the toothbrush of FIG. 22.
Figure 24:
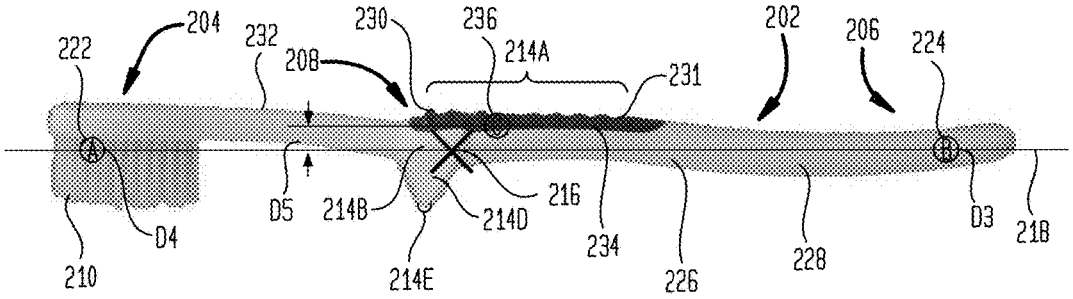
FIG. 24 is a side elevation view showing the toothbrush of FIG. 22.

Turning now to FIGS. 22-24, another example embodiment of a self-righting toothbrush 202 is shown. The toothbrush 202 is similar in construction to the toothbrush 102 of FIGS. 11-20, and corresponding structure is indicated by corresponding reference numbers that have been incremented by 100. A principal difference between the toothbrushes 102 and 202 is that the latter has a modified medial section 208 that includes an external ballast 234 on the same side of the toothbrush shaft as the reference protrusion 214A. The ballast 234 is "external" because it exposed at a surface of the toothbrush shaft rather than being hidden completely internally within.

The purpose of the ballast 234 is to induce the toothbrush 202 to roll on a support surface (such as the support surface 120 of FIGS. 14-16) from an unstable orientation, such as when the bristles 210 extend in a non-vertical direction, to a stable orientation wherein the bristles extend in a vertical direction in either a bristles up position or a bristles down position. To that end, the ballast 234 may be formed of a higher-density material than the remainder of the toothbrush shaft. For example, the ballast 234 may be formed from a relatively high-density polymer and the remainder of the toothbrush shaft could be formed from a relatively low-density polymer. Alternatively, the ballast 234 could be formed from a relatively high-density rubberized material that provides various additional advantages, as described in more detail below.

In the illustrated embodiment, the ballast 234 provides the reference protrusion 214A. In other embodiments (not shown), the ballast 234 may provide only a portion of the reference protrusion 214A. In still other embodiments (not shown), the ballast 234 may not provide any portion of the reference protrusion 214A.

The ballast 234 may be provided to obviate or assist the use of other techniques for inducing toothbrush rolling, such as forming the toothbrush tail section with a rearward lateral asymmetry as discussed in connection with previous embodiments. In the toothbrush 202, the toothbrush could be designed so that the center of mass 224 of the tail section 206 lie on the longitudinal axis 218 when the toothbrush is a bristles side-ways position (see FIG. 24), and thereby provide no rotation-inducing moment. The center of mass of the head section 204 may also lie on the longitudinal axis 218, and likewise provide no rotation-inducing moment. FIG. 24 depicts an example embodiment wherein substantially all rotational moment is provided by the ballast 234 when the toothbrush 202 is in the bristles-sideways position. In this embodiment, the ballast 234 has a center of mass 236 (Mass "C") that is offset from the longitudinal axis 218 by a distance "D5". The rotational moment provided by the ballast (MomentC) equals MassC×D5. The tail section center of mass 224 is shown as being in line with the longitudinal axis 218, such that its spacing distance "D3"=0. The head section center of mass 222 is likewise in line with the longitudinal axis 218, such that its spacing distance "D4"=0. In this configuration, the tail section rotational moment (MomentB), which equals MassB×D3, is zero and has no effect on toothbrush rotation in the position shown in FIG. 24. Similarly, the head section rotational moment (MomentA), which equals MassA×D4, is zero and has no effect on toothbrush rotation in the position shown in FIG. 24. The ballast rotational moment (MomentC), which equals MassB×D5, urges the toothbrush 202 to pivot toward the bristles up position. Alternatively, if the toothbrush 202 was configured in the manner shown in FIG. 21 with the ballast 231 being located on the bristle-side of the toothbrush, the ballast rotational moment (MomentC) would urge the toothbrush 202 to pivot toward a bristles down position.

It will be appreciated that the above-described toothbrush configuration could be modified so that the tail section center of mass 224 is rearwardly offset from longitudinal axis 218 when the toothbrush 202 is in the bristles sideways position of FIG. 24. In that case, both the ballast center of mass 236 and the tail section center of mass 224 contribute to rolling the toothbrush 202 to its stable down orientation. The toothbrush 202 could likewise be designed so that the head section center of mass 222 is also rearwardly offset from the longitudinal axis when the toothbrush is in the bristles sideways position of FIG. 24. In that case, the combined moment of the ballast center of mass 236, the tail section center of mass 224, and the head section center of mass would all contribute to rolling the toothbrush 202 to is stable down orientation. A further modification would be to configure the toothbrush 202 so that one or both of the tail section center of mass 224 and the head section center of mass 222 will be frontwardly offset from the longitudinal axis when the toothbrush is in the bristles sideways position of FIG. 24. Although the centers of mass 224 and 222 would create adverse moments tending to roll the toothbrush away from its stable orientation, the weight and positioning of the ballast center of mass 236 could be selected to provide a favorable moment that overcomes the adverse moments. In this way, the ballast 234 gives the toothbrush designer more freedom to configure the head and tail sections 204 and 206 as they see fit, while relying on the ballast 234 to provide the desired self-righting capability of the toothbrush 202.

As noted above, the ballast 234 may comprise a higher density material than the material that comprises the remainder of the toothbrush shaft. It may also be softer and more resilient. For example, the ballast 234 may be formed from a high density rubber material, whereas the remainder of the toothbrush shaft may be formed from a relative hard polymer, such as polypropylene or low density polyethylene. In the illustrated embodiment wherein the ballast 234 provides the reference protrusion 214A, forming the ballast 234 from a relatively soft material has the advantage of cushioning and braking the toothbrush 202 as it rolls to the its stable orientation. By providing relatively soft contact between the reference protrusion 214A and the support surface on which the toothbrush 202 rolls, the support surface is less likely to be scratched or marred.

As shown in FIG. 23, the ballast 234 may be mounted in a pocket 238 formed in the toothbrush shaft. The pocket 238 may include a pocket bottom 238A that is recessed from the nominal surrounding toothbrush surface in which the pocket is formed. The pocket 238 may further include a pocket sidewall 238B that extends from the pocket bottom 238A to the nominal surrounding toothbrush surface. Correspondingly, the ballast 234 includes a bottom portion 234A that engages the pocket bottom 238A, and a sidewall portion 234B that engages the pocket sidewall 238B. The ballast 234 may fabricated and secured in the pocket 238 in any desired manner. In an embodiment, the toothbrush shaft may be formed as an injection-molded article and the ballast 234 may be formed as an overmolded member, using an overmolding process to mold the ballast directly into the pocket 238. Alternatively, the ballast 234 could be fabricated separated and securing in the pocket 238 using mechanical coupling, such as adhesive bonding.

In the illustrated embodiment, the ballast 234 is limited to the medial section of the toothbrush, and as noted, provides the reference protrusion 214A. The ballast 234 is shown as being exposed at a surface portion of the toothbrush shaft that encompasses less than all sides of the shaft. In particular, the ballast 234 encompasses only one side of the toothbrush shaft. However, the ballast 234 could be extended onto the lateral edges of the toothbrush shaft, if desired. The ballast 234 could also extend completely around the periphery of the toothbrush shaft, so long as it is configured so that its center of mass is located to provide the desired toothbrush self-righting capability.

As can be seen in FIGS. 22-24, the ballast 234 may have an outer contour of irregular shape along the longitudinal length thereof that is exposed at a surface of the toothbrush shaft. For example, as shown in FIG. 24, the outer contour of the ballast 234 may be gradually curved to match the curved longitudinal profile of the rearward toothbrush shaft surface on which the ballast is situated. As additionally shown in FIGS. 22 and 23, the ballast 234 may include one or more surface texture features that provide a finger gripping surface, such as the ridges 230 and/or the channels 231.

As previously noted, the ballast 234 may provide some or all of the reference protrusion 214A. Because the reference protrusion 214A will then form part of the pivot surface of the toothbrush 202, the ballast 234 in such embodiments may likewise be thought of as forming part of the pivot surface. As in the toothbrush 102 of FIG. 11, the pivot surface of the toothbrush 202 may further include a prominent primary protrusion 214D that juts out significantly from the nominal frontward surface of the toothbrush shaft, and a pair of lateral protrusions 214B. The primary protrusion is relatively tall. At least a portion of the ballast 234 may be disposed on the rearward side of the toothbrush shaft, opposite from where the primary protrusion 214D is located, forming some or all of the reference protrusion 214A, which is relatively flat. With this configuration, when the toothbrush 202 rests on a support surface with the primary protrusion 214D in contact therewith, the center of mass 236 of the ballast 234 will be raised off the support surface due to the height of the primary protrusion. This will have the effect of increasing the moment arm of the ballast 234 relative to the instantaneous pivot point of the toothbrush 202, to aid in toothbrush rotation. In contrast, when the toothbrush 202 is resting with the reference protrusion 114A in contact with the support surface, the ballast center of mass 236 will be very close to the support surface to help maintain the toothbrush in its stable orientation.

Notwithstanding the foregoing, it would also be possible to provide a ballast on a toothbrush that does not have a prominent primary protrusion, such as the toothbrush 2 of FIG. 1. Thus, the above description of incorporating a ballast into the toothbrush embodiment of FIG. 11 is for purposes of illustration only.

Accordingly, embodiments of a self-righting toothbrush have been disclosed. The self-righting feature naturally pivots the toothbrush to its bristles up position. This isolates the bristles from the support surface in most instances when the toothbrush is dropped or placed onto the support surface. The toothbrush does so by harnessing the benefits of rotational inertia by utilizing the formula W (weight) times A (arm) equals Moment, the same basic formula used for aircraft balancing. The toothbrush utilizes the foregoing formula to provide a design that will naturally be at an equilibrium state with the toothbrush resting in the bristles up position.

Advantageously, the toothbrush has the appearance of a traditional toothbrush and can be designed to fit into any traditional toothbrush holder. In addition, there is no learning curve to it use. As the toothbrush is placed or even tossed on the support surface, it will automatically self orient itself into the desired bristles up position.

Although example embodiments of the disclosed subject matter have been shown and described, it should be apparent that many variations and alternative embodiments could be implemented in accordance with the present disclosure. It is understood, therefore, that the invention is not to be in any way limited except in accordance with the spirit of the appended claims and their equivalents.

What is claimed is:

1. A self-righting toothbrush, comprising:

a shaft having a first side, a second side and a pair of lateral edges;

said shaft defining a head section, a tail section and a medial section, said medial section being disposed at a junction of said head section and said tail section in a longitudinal direction of said toothbrush;

said head section mounting a set of bristles on said first side of said shaft;

said medial section having a curved pivot surface configured to contact a horizontal support surface at a pivot point, said pivot surface allowing said toothbrush to roll on said support surface;

said pivot point lying on said pivot surface and representing its instantaneous point of contact with said support surface at any given rotational position of said toothbrush, said pivot point lying in a vertical plane that is substantially perpendicular to a rolling direction of said toothbrush; and an external ballast exposed at a surface of said shaft, said ballast being positioned to induce said toothbrush to roll on said support surface from an unstable orientation wherein said bristles extend in a non-vertical direction, to a stable orientation wherein said bristles extend in a vertical direction in either a bristles up position or a bristles down position; and one or more of said ballast, said medial section or said tail section having an outer contour that is curved in the longitudinal direction such there is at least one gap between said toothbrush and said reference surface when said toothbrush is in said stable orientation.

2. The toothbrush of claim 1, wherein said ballast comprises one or more surface texture features that include one or both of ridges or channels.

3. The toothbrush of claim 1, wherein said outer contour of said ballast forms part of said pivot surface.

4. The toothbrush of claim 1, wherein said toothbrush shaft comprises a molded article and said ballast comprises an overmolded member.

5. The toothbrush of claim 1, wherein said ballast comprises a higher density material than said shaft.

6. The toothbrush of claim 1, wherein said ballast comprises a softer material than said shaft.

7. The toothbrush of claim 1, wherein said ballast is exposed at a surface portion of said shaft that encompasses less than all sides of said shaft.

8. A self-righting toothbrush, comprising:

a shaft having a first side, a second side and a pair of lateral edges;

said shaft defining a head section, a tail section and a medial section, said medial section being disposed at a junction of said head section and said tail section in a longitudinal direction of said toothbrush;

said head section mounting a set of bristles on said first side of said shaft;

said medial section having a curved pivot surface configured to contact a horizontal support surface at a pivot point, said pivot surface allowing said toothbrush to roll on said support surface;

said pivot point lying on said pivot surface and representing its instantaneous point of contact with said support surface at any given rotational position of said toothbrush, said pivot point lying in a vertical plane that is substantially perpendicular to a rolling direction of said toothbrush; and an external ballast having an outer contour of irregular shape along a longitudinal length thereof that is exposed at a surface of said shaft, said ballast being positioned to induce said toothbrush to roll on said support surface from an unstable orientation wherein said bristles extend in a non-vertical direction, to a stable orientation wherein said bristles extend in a vertical direction in either a bristles up position or a bristles down position; and wherein said ballast is mounted in a pocket formed in said toothbrush shaft.

9. A self-righting toothbrush, comprising:

a shaft having a first side, a second side and a pair of lateral edges;

said shaft defining a head section, a tail section and a medial section, said medial section being disposed at a junction of said head section and said tail section in a longitudinal direction of said toothbrush;

said head section mounting a set of bristles on said first side of said shaft;

said medial section having a curved pivot surface configured to contact a horizontal support surface at a pivot point, said pivot surface allowing said toothbrush to roll on said support surface;

said pivot point lying on said pivot surface and representing its instantaneous point of contact with said support surface at any given rotational position of said toothbrush, said pivot point lying in a vertical plane that is substantially perpendicular to a rolling direction of said toothbrush; and an external ballast having an outer contour of irregular shape along a longitudinal length thereof that is exposed at a surface of said shaft, said ballast being positioned to induce said toothbrush to roll on said support surface from an unstable orientation wherein said bristles extend in a non-vertical direction, to a stable orientation wherein said bristles extend in a vertical direction in either a bristles up position or a bristles down position; and wherein said ballast is limited to said medial section of said toothbrush.

10. A self-righting toothbrush, comprising:

a shaft having a first side, a second side and a pair of lateral edges;

said shaft defining a head section, a tail section and a medial section, said medial section being disposed at a junction of said head section and said tail section in a longitudinal direction of said toothbrush;

said head section mounting a set of bristles on said first side of said shaft;

said medial section having a curved pivot surface configured to contact a horizontal support surface at a pivot point, said pivot surface allowing said toothbrush to roll on said support surface;

said pivot point lying on said pivot surface and representing its instantaneous point of contact with said support surface at any given rotational position of said toothbrush, said pivot point lying in a vertical plane that is substantially perpendicular to a rolling direction of said toothbrush; and an external ballast having an outer contour of irregular shape along a longitudinal length thereof that is exposed at a surface of said shaft, said ballast being positioned to induce said toothbrush to roll on said support surface from an unstable orientation wherein said bristles extend in a non-vertical direction, to a stable orientation wherein said bristles extend in a vertical direction in either a bristles up position or a bristles down position; and wherein said outer contour of said ballast forms a relatively flat reference protrusion of said pivot surface that is opposite from a relatively tall primary protrusion of said pivot surface.

11. A self-righting toothbrush, comprising:

a shaft having a first side, a second side and a pair of lateral edges;

said shaft defining a head section, a tail section and a medial section, said medial section being disposed at a junction of said head section and said tail section in a longitudinal direction of said toothbrush;

said head section mounting a set of bristles on said first side of said shaft;

said medial section having a curved pivot surface configured to contact a horizontal support surface at a pivot point, said pivot surface allowing said toothbrush to roll on said support surface;

said pivot point lying on said pivot surface and representing its instantaneous point of contact with said support surface at any given rotational position of said toothbrush, said pivot point lying in a vertical plane that is substantially perpendicular to a rolling direction of said toothbrush; and an external ballast having an outer contour exposed at a surface of said shaft, said ballast being limited to said medial section of said toothbrush and positioned to induce said toothbrush to roll on said support surface from an unstable orientation wherein said bristles extend in a non-vertical direction, to a stable orientation wherein said bristles extend in a vertical direction in either a bristles up position or a bristles down position.

12. The toothbrush of claim 11, wherein said ballast comprises one or more surface texture features that include one or both of ridges or channels.

13. The toothbrush of claim 11, wherein said outer contour of said ballast forms part of said pivot surface.

14. The toothbrush of claim 11, wherein said ballast is mounted in a pocket formed in said toothbrush shaft.

15. The toothbrush of claim 11, wherein said toothbrush shaft comprises a molded article and said ballast comprises an overmolded member.

16. The toothbrush of claim 11, wherein said ballast comprises a higher density material than said shaft.

17. The toothbrush of claim 11, wherein said ballast comprises a softer material than said shaft.

18. The toothbrush of claim 11, wherein said ballast is exposed at a surface portion of said shaft that encompasses less than all sides of said shaft.

19. The toothbrush of claim 11, wherein said ballast outer contour is of irregular shape in a longitudinal direction thereof.

20. The toothbrush of claim 11, wherein said outer contour of said ballast forms a relatively flat reference protrusion of said pivot surface that is opposite from a relatively tall primary protrusion of said pivot surface.

21. A self-righting toothbrush, comprising:

a shaft having a first side, a second side and a pair of lateral edges;

said shaft defining a head section, a tail section and a medial section, said medial section being disposed at a junction of said head section and said tail section in a longitudinal direction of said toothbrush;

said head section mounting a set of bristles on said first side of said shaft;

said medial section having a curved pivot surface configured to contact a horizontal support surface at a pivot point, said pivot surface allowing said toothbrush to roll on said support surface;

said pivot point lying on said pivot surface and representing its instantaneous point of contact with said support surface at any given rotational position of said toothbrush, said pivot point lying in a vertical plane that is substantially perpendicular to a rolling direction of said toothbrush;

said pivot surface being provided in part by a relatively tall primary protrusion defined on a first one of said first or second sides of said shaft;

said pivot surface being further provided in part by a relatively flat reference protrusion defined on a second one of said first or second sides of said shaft;

an external ballast having an outer contour exposed at a surface of said shaft, said ballast being positioned to induce said toothbrush to roll on said support surface from an unstable orientation wherein said bristles extend in a non-vertical direction, to a stable orientation wherein said bristles extend in a vertical direction in either a bristles up position or a bristles down position; and said outer contour of said ballast comprising said relatively flat reference protrusion.

22. The toothbrush of claim 21, wherein said ballast comprises one or more surface texture features that include one or both of ridges or channels.

23. The toothbrush of claim 21, wherein said outer contour of said ballast forms part of said pivot surface.

24. The toothbrush of claim 21, wherein said ballast is mounted in a pocket formed in said toothbrush shaft.

25. The toothbrush of claim 21, wherein said toothbrush shaft comprises a molded article and said ballast comprises an overmolded member.

26. The toothbrush of claim 21, wherein said ballast comprises a higher density material than said shaft.

27. The toothbrush of claim 21, wherein said ballast comprises a softer material than said shaft.

28. The toothbrush of claim 21, wherein said ballast is exposed at a surface portion of said shaft that encompasses less than all sides of said shaft.

29. The toothbrush of claim 21, wherein said ballast outer contour is of irregular shape in a longitudinal direction thereof.

30. The toothbrush of claim 21, wherein said ballast is limited to said medial section of said toothbrush.

* * * * *